US009732763B2

(12) United States Patent
Peters

(10) Patent No.: US 9,732,763 B2
(45) Date of Patent: Aug. 15, 2017

(54) FAN ASSEMBLY

(71) Applicant: Dyson Technology Limited, Wiltshire (GB)

(72) Inventor: Laurent James Peters, Malmesbury (GB)

(73) Assignee: Dyson Technology Limited, Malmesbury, Wiltshire (GB)

( * ) Notice: Subject to any disclaimer, the term of this patent is extended or adjusted under 35 U.S.C. 154(b) by 714 days.

(21) Appl. No.: 13/938,957

(22) Filed: Jul. 10, 2013

(65) Prior Publication Data

US 2014/0017069 A1 Jan. 16, 2014

(30) Foreign Application Priority Data

Jul. 11, 2012 (GB) ..... 1212323.8

(51) Int. Cl.
*F04D 29/46* (2006.01)
*F04D 25/08* (2006.01)
*F04F 5/16* (2006.01)

(52) U.S. Cl.
CPC ..... *F04D 29/462* (2013.01); *F04D 25/08* (2013.01); *F04F 5/16* (2013.01)

(58) Field of Classification Search
CPC .... F04D 29/462; F04D 29/601; F04D 29/626; F04D 25/08; F04D 25/10; F04D 25/105; F04F 5/16
See application file for complete search history.

(56) References Cited

U.S. PATENT DOCUMENTS 1,357,261 A 11/1920 Svoboda
1,767,060 A 6/1930 Ferguson
1,896,869 A 2/1933 Larsh
2,014,185 A 9/1935 Martin
2,035,733 A 3/1936 Wall
D103,476 S 3/1937 Weber
(Continued)

FOREIGN PATENT DOCUMENTS

AU 2008323324 5/2009
AU 201100923 9/2011
(Continued)

OTHER PUBLICATIONS

Search Report dated Nov. 13, 2012, directed to GB Application No. 1212323.8; 1 page.
(Continued)

*Primary Examiner* — Justin Seabe
(74) *Attorney, Agent, or Firm* — Morrison & Foerster LLP

(57) ABSTRACT

A fan assembly includes a base and a body mounted on the base for movement relative thereto between an untilted position and a tilted position. The fan assembly also includes an air outlet and an interior passage for conveying air to the air outlet, and which extends about an opening through which air from outside the fan assembly is drawn by air emitted from the air outlet. A brake and a stationary rail are disposed on the upper surface of the base, and a rail is connected to the lower surface of the body and located between the brake and the stationary rail. The brake is urged by a spring or other resilient member towards the stationary rail to urge the rail of the body against the stationary rail to maintain the body in a tilted position by means of friction between the rails.

20 Claims, 10 Drawing Sheets

(56) References Cited

U.S. PATENT DOCUMENTS 2,115,883 A 5/1938 Sher
D115,344 S 6/1939 Chapman
2,210,458 A 8/1940 Keilholtz
2,258,961 A 10/1941 Saathoff
2,336,295 A 12/1943 Reimuller
2,433,795 A 12/1947 Stokes
2,473,325 A 6/1949 Aufiero
2,476,002 A 7/1949 Stalker
2,488,467 A 11/1949 De Lisio
2,510,132 A 6/1950 Morrison
2,544,379 A 3/1951 Davenport
2,547,448 A 4/1951 Demuth
2,583,374 A 1/1952 Hoffman
2,620,127 A 12/1952 Radcliffe
2,765,977 A 10/1956 Morrison
2,808,198 A 10/1957 Morrison
2,813,673 A 11/1957 Smith
2,830,779 A 4/1958 Wentling
2,838,229 A 6/1958 Belanger
2,922,277 A 1/1960 Bertin
2,922,570 A 1/1960 Allen
3,004,403 A 10/1961 Laporte
3,047,208 A 7/1962 Coanda
3,270,655 A 9/1966 Guirl et al.
D206,973 S 2/1967 De Lisio
3,444,817 A 5/1969 Caldwell
3,503,138 A 3/1970 Fuchs et al.
3,518,776 A 7/1970 Wolff et al.
3,724,092 A 4/1973 McCleerey
3,743,186 A 7/1973 Mocarski
3,795,367 A 3/1974 Mocarski
3,872,916 A 3/1975 Beck
3,875,745 A 4/1975 Franklin
3,885,891 A 5/1975 Throndson
3,943,329 A 3/1976 Hlavac
4,037,991 A 7/1977 Taylor
4,046,492 A 9/1977 Inglis
4,061,188 A 12/1977 Beck
4,073,613 A 2/1978 Desty
4,113,416 A 9/1978 Kataoka et al.
4,136,735 A 1/1979 Beck et al.
4,173,995 A 11/1979 Beck
4,180,130 A 12/1979 Beck et al.
4,184,541 A 1/1980 Beck et al.
4,192,461 A 3/1980 Arborg
4,332,529 A 6/1982 Alperin
4,336,017 A 6/1982 Desty
4,342,204 A 8/1982 Melikian et al.
4,448,354 A 5/1984 Reznick et al.
4,502,837 A 3/1985 Blair et al.
4,568,243 A 2/1986 Schubert et al.
4,630,475 A 12/1986 Mizoguchi
4,643,351 A 2/1987 Fukamachi et al.
4,703,152 A 10/1987 Shih-Chin
4,718,870 A 1/1988 Watts
4,732,539 A 3/1988 Shin-Chin
4,790,133 A 12/1988 Stuart
4,850,804 A 7/1989 Huang
4,878,620 A 11/1989 Tarleton
4,893,990 A 1/1990 Tomohiro et al.
4,978,281 A 12/1990 Conger
5,061,405 A 10/1991 Stanek et al.
D325,435 S 4/1992 Coup et al.
5,168,722 A 12/1992 Brock
5,176,856 A 1/1993 Takahashi et al.
5,188,508 A 2/1993 Scott et al.
5,296,769 A 3/1994 Havens et al.
5,310,313 A 5/1994 Chen
5,317,815 A 6/1994 Hwang
5,395,087 A 3/1995 VanBasten
5,402,938 A 4/1995 Sweeney
5,407,324 A 4/1995 Starnes, Jr. et al.
5,425,902 A 6/1995 Miller et al.
5,518,370 A 5/1996 Wang et al.
5,609,473 A 3/1997 Litvin
5,613,833 A * 3/1997 Wolfe ..... F04D 29/601 416/246
5,645,769 A 7/1997 Tamaru et al.
5,649,370 A 7/1997 Russo
5,720,594 A 2/1998 Snow
5,730,582 A 3/1998 Heitmann
5,735,683 A 4/1998 Muschelknautz
5,762,034 A 6/1998 Foss
5,762,661 A 6/1998 Kleinberger et al.
5,783,117 A 7/1998 Byassee et al.
D398,983 S 9/1998 Keller et al.
5,841,080 A 11/1998 Iida et al.
5,843,344 A 12/1998 Junkel et al.
5,862,037 A 1/1999 Behl
5,868,197 A 2/1999 Potier
5,881,685 A 3/1999 Foss et al.
D415,271 S 10/1999 Feer
6,015,274 A 1/2000 Bias et al.
6,065,936 A 5/2000 Shingai et al.
6,073,881 A 6/2000 Chen
6,082,969 A 7/2000 Carroll et al.
D429,808 S 8/2000 Krauss et al.
6,123,618 A 9/2000 Day
6,155,782 A 12/2000 Hsu
D435,899 S 1/2001 Melwani
6,244,823 B1 6/2001 Marino et al.
6,254,337 B1 7/2001 Arnold
6,269,549 B1 8/2001 Carlucci et al.
6,278,248 B1 8/2001 Hong et al.
6,282,746 B1 9/2001 Schleeter
6,293,121 B1 9/2001 Labrador
6,321,034 B2 11/2001 Jones-Lawlor et al.
6,338,610 B1 1/2002 Harada et al.
6,348,106 B1 2/2002 Embree et al.
6,386,845 B1 5/2002 Bedard
6,454,527 B2 9/2002 Nishiyama et al.
6,480,672 B1 11/2002 Rosenzweig et al.
6,511,288 B1 1/2003 Gatley, Jr.
6,599,088 B2 7/2003 Stagg
D485,895 S 1/2004 Melwani
6,709,236 B1 3/2004 Hoelzer
6,789,787 B2 9/2004 Stutts
6,830,433 B2 12/2004 Birdsell et al.
6,932,579 B2 8/2005 Cichetti, Sr. et al.
7,059,826 B2 6/2006 Lasko
7,088,913 B1 8/2006 Verhoorn et al.
7,147,336 B1 12/2006 Chou
D539,414 S 3/2007 Russak et al.
7,186,075 B2 3/2007 Winkler et al.
7,189,053 B2 3/2007 Winkler et al.
7,317,267 B2 1/2008 Schmid et al.
7,455,504 B2 11/2008 Hill et al.
7,478,993 B2 1/2009 Hong et al.
7,540,474 B1 6/2009 Huang et al.
D598,532 S 8/2009 Dyson et al.
D602,143 S 10/2009 Gammack et al.
D602,144 S 10/2009 Dyson et al.
D605,748 S 12/2009 Gammack et al.
7,664,377 B2 2/2010 Liao
D614,280 S 4/2010 Dyson et al.
7,775,848 B1 8/2010 Auerbach
7,806,388 B2 10/2010 Junkel et al.
7,921,962 B2 4/2011 Liddell
8,092,166 B2 1/2012 Nicolas et al.
8,430,624 B2 4/2013 Cookson et al.
8,469,658 B2 6/2013 Gammack et al.
2002/0106547 A1 8/2002 Sugawara et al.
2003/0059307 A1 3/2003 Moreno et al.
2003/0171093 A1 9/2003 Gumucio Del Pozo
2003/0174834 A1* 9/2003 Kida ..... H04M 1/02 379/428.01
2004/0022631 A1 2/2004 Birdsell et al.
2004/0049842 A1 3/2004 Prehodka
2004/0149881 A1 8/2004 Allen
2005/0031448 A1 2/2005 Lasko et al.
2005/0053465 A1 3/2005 Roach et al.
2005/0069407 A1 3/2005 Winkler et al.
2005/0128698 A1 6/2005 Huang
2005/0163670 A1 7/2005 Alleyne et al.

(56) References Cited

U.S. PATENT DOCUMENTS

| | | | |
|---|---|---|---|
| 2005/0173997 | A1 | 8/2005 | Schmid et al. |
| 2005/0276684 | A1 | 12/2005 | Huang et al. |
| 2005/0281672 | A1 | 12/2005 | Parker et al. |
| 2006/0172682 | A1 | 8/2006 | Orr et al. |
| 2006/0199515 | A1 | 9/2006 | Lasko et al. |
| 2007/0035189 | A1 | 2/2007 | Matsumoto |
| 2007/0041857 | A1 | 2/2007 | Fleig |
| 2007/0048159 | A1 | 3/2007 | DiMatteo et al. |
| 2007/0065280 | A1 | 3/2007 | Fok |
| 2007/0166160 | A1 | 7/2007 | Russak et al. |
| 2007/0176502 | A1 | 8/2007 | Kasai et al. |
| 2007/0224044 | A1 | 9/2007 | Hong et al. |
| 2007/0269323 | A1 | 11/2007 | Zhou et al. |
| 2008/0020698 | A1 | 1/2008 | Spaggiari |
| 2008/0152482 | A1 | 6/2008 | Patel |
| 2008/0166224 | A1 | 7/2008 | Giffin |
| 2008/0286130 | A1 | 11/2008 | Purvines |
| 2008/0304986 | A1 | 12/2008 | Kenyon et al. |
| 2008/0314250 | A1 | 12/2008 | Cowie et al. |
| 2009/0026850 | A1 | 1/2009 | Fu |
| 2009/0039805 | A1 | 2/2009 | Tang |
| 2009/0060710 | A1 | 3/2009 | Gammack et al. |
| 2009/0060711 | A1 | 3/2009 | Gammack et al. |
| 2009/0191054 | A1 | 7/2009 | Winkler |
| 2009/0214341 | A1 | 8/2009 | Craig |
| 2010/0150699 | A1 | 6/2010 | Nicolas et al. |
| 2010/0162011 | A1 | 6/2010 | Min |
| 2010/0171465 | A1 | 7/2010 | Seal et al. |
| 2010/0225012 | A1 | 9/2010 | Fitton et al. |
| 2010/0226749 | A1 | 9/2010 | Gammack et al. |
| 2010/0226750 | A1 | 9/2010 | Gammack |
| 2010/0226751 | A1 | 9/2010 | Gammack et al. |
| 2010/0226752 | A1 | 9/2010 | Gammack et al. |
| 2010/0226753 | A1 | 9/2010 | Dyson et al. |
| 2010/0226754 | A1 | 9/2010 | Hutton et al. |
| 2010/0226758 | A1 | 9/2010 | Cookson et al. |
| 2010/0226763 | A1 | 9/2010 | Gammack et al. |
| 2010/0226764 | A1 | 9/2010 | Gammack et al. |
| 2010/0226769 | A1 | 9/2010 | Helps |
| 2010/0226771 | A1 | 9/2010 | Crawford et al. |
| 2010/0226787 | A1* | 9/2010 | Gammack ..... F04D 25/08 416/246 |
| 2010/0226797 | A1 | 9/2010 | Fitton et al. |
| 2010/0226801 | A1 | 9/2010 | Gammack |
| 2010/0254800 | A1 | 10/2010 | Fitton et al. |
| 2011/0002775 | A1 | 1/2011 | Ma et al. |
| 2011/0058935 | A1 | 3/2011 | Gammack et al. |
| 2011/0110805 | A1 | 5/2011 | Gammack et al. |
| 2011/0164959 | A1 | 7/2011 | Fitton et al. |
| 2011/0223014 | A1 | 9/2011 | Crawford et al. |
| 2011/0223015 | A1 | 9/2011 | Gammack et al. |
| 2012/0031509 | A1 | 2/2012 | Wallace et al. |
| 2012/0033952 | A1 | 2/2012 | Wallace et al. |
| 2012/0034108 | A1 | 2/2012 | Wallace et al. |
| 2012/0039705 | A1 | 2/2012 | Gammack |
| 2012/0045315 | A1 | 2/2012 | Gammack |
| 2012/0045316 | A1 | 2/2012 | Gammack |
| 2012/0057959 | A1 | 3/2012 | Hodgson et al. |
| 2012/0082561 | A1 | 4/2012 | Gammack et al. |
| 2012/0093629 | A1 | 4/2012 | Fitton et al. |
| 2012/0093630 | A1 | 4/2012 | Fitton et al. |
| 2012/0114513 | A1 | 5/2012 | Simmonds et al. |
| 2012/0230658 | A1 | 9/2012 | Fitton et al. |
| 2013/0011252 | A1 | 1/2013 | Crawford et al. |
| 2013/0045084 | A1 | 2/2013 | Tu et al. |
| 2013/0189083 | A1 | 7/2013 | Atkinson |
| 2013/0302156 | A1 | 11/2013 | Nurzynski |
| 2013/0309065 | A1 | 11/2013 | Johnson et al. |
| 2013/0309066 | A1 | 11/2013 | Atkinson et al. |
| 2013/0309080 | A1 | 11/2013 | Johnson et al. |
| 2013/0323025 | A1 | 12/2013 | Crawford et al. |

FOREIGN PATENT DOCUMENTS

| | | |
|---|---|---|
| BE | 560119 | 8/1957 |
| CA | 1055344 | 5/1979 |
| CA | 2155482 | 9/1996 |
| CH | 346643 | 5/1960 |
| CN | 87 2 02488 | 3/1988 |
| CN | 2085866 | 10/1991 |
| CN | 2111392 | 7/1992 |
| CN | 2228996 | 6/1996 |
| CN | 1232143 | 10/1999 |
| CN | 1288506 | 3/2001 |
| CN | 1336482 | 2/2002 |
| CN | 1437300 | 8/2003 |
| CN | 2650005 | 10/2004 |
| CN | 2713643 | 7/2005 |
| CN | 1680727 | 10/2005 |
| CN | 2806846 | 8/2006 |
| CN | 2833197 | 11/2006 |
| CN | 101046318 | 10/2007 |
| CN | 200966872 | 10/2007 |
| CN | 201180678 | 1/2009 |
| CN | 201221477 | 4/2009 |
| CN | 201281416 | 7/2009 |
| CN | 101560988 | 10/2009 |
| CN | 201349269 | 11/2009 |
| CN | 101749288 | 6/2010 |
| CN | 201502549 | 6/2010 |
| CN | 101816534 | 9/2010 |
| CN | 101825095 | 9/2010 |
| CN | 101825102 | 9/2010 |
| CN | 201568337 | 9/2010 |
| CN | 101936310 | 1/2011 |
| CN | 101984299 | 3/2011 |
| CN | 101985948 | 3/2011 |
| CN | 201763705 | 3/2011 |
| CN | 201763706 | 3/2011 |
| CN | 201770513 | 3/2011 |
| CN | 201779080 | 3/2011 |
| CN | 201802648 | 4/2011 |
| CN | 102095236 | 6/2011 |
| CN | 102305220 | 1/2012 |
| CN | 102367813 | 3/2012 |
| CN | 202165330 | 3/2012 |
| DE | 1 291 090 | 3/1969 |
| DE | 24 51 557 | 5/1976 |
| DE | 27 48 724 | 5/1978 |
| DE | 3644567 | 7/1988 |
| DE | 41 27 134 | 2/1993 |
| DE | 195 10 397 | 9/1996 |
| DE | 197 12 228 | 10/1998 |
| DE | 100 00 400 | 3/2001 |
| DE | 10041805 | 6/2002 |
| DE | 10 2009 007 037 | 8/2010 |
| DE | 10 2009 044 349 | 5/2011 |
| EP | 0 044 494 | 1/1982 |
| EP | 0186581 | 7/1986 |
| EP | 0 955 469 | 11/1999 |
| EP | 1 094 224 | 4/2001 |
| EP | 1 138 954 | 10/2001 |
| EP | 1 566 548 | 8/2005 |
| EP | 1 779 745 | 5/2007 |
| EP | 1 939 456 | 7/2008 |
| EP | 1 980 432 | 10/2008 |
| EP | 2 000 675 | 12/2008 |
| EP | 2191142 | 6/2010 |
| FR | 1033034 | 7/1953 |
| FR | 1119439 | 6/1956 |
| FR | 1.387.334 | 1/1965 |
| FR | 2 534 983 | 4/1984 |
| FR | 2 640 857 | 6/1990 |
| FR | 2 658 593 | 8/1991 |
| FR | 2794195 | 12/2000 |
| FR | 2 874 409 | 2/2006 |
| FR | 2 906 980 | 4/2008 |
| GB | 22235 | 6/1914 |
| GB | 383498 | 11/1932 |
| GB | 593828 | 10/1947 |
| GB | 601222 | 4/1948 |

(56) References Cited

FOREIGN PATENT DOCUMENTS

| | | |
|---|---|---|
| GB | 633273 | 12/1949 |
| GB | 641622 | 8/1950 |
| GB | 661747 | 11/1951 |
| GB | 863 124 | 3/1961 |
| GB | 1067956 | 5/1967 |
| GB | 1 262 131 | 2/1972 |
| GB | 1 265 341 | 3/1972 |
| GB | 1 278 606 | 6/1972 |
| GB | 1 304 560 | 1/1973 |
| GB | 1 403 188 | 8/1975 |
| GB | 1 434 226 | 5/1976 |
| GB | 1 501 473 | 2/1978 |
| GB | 2 094 400 | 9/1982 |
| GB | 2 107 787 | 5/1983 |
| GB | 2 111 125 | 6/1983 |
| GB | 2 178 256 | 2/1987 |
| GB | 2 185 531 | 7/1987 |
| GB | 2 185 533 | 7/1987 |
| GB | 2 218 196 | 11/1989 |
| GB | 2 236 804 | 4/1991 |
| GB | 2 237 323 | 5/1991 |
| GB | 2 240 268 | 7/1991 |
| GB | 2 242 935 | 10/1991 |
| GB | 2 285 504 | 7/1995 |
| GB | 2 289 087 | 11/1995 |
| GB | 2383277 | 6/2003 |
| GB | 2 428 569 | 2/2007 |
| GB | 2 452 490 | 3/2009 |
| GB | 2 452 593 | 3/2009 |
| GB | 2463698 | 3/2010 |
| GB | 2464736 | 4/2010 |
| GB | 2466058 | 6/2010 |
| GB | 2468312 | 9/2010 |
| GB | 2468313 | 9/2010 |
| GB | 2468315 | 9/2010 |
| GB | 2468319 | 9/2010 |
| GB | 2468320 | 9/2010 |
| GB | 2468323 | 9/2010 |
| GB | 2468328 | 9/2010 |
| GB | 2468331 | 9/2010 |
| GB | 2468369 | 9/2010 |
| GB | 2473037 | 3/2011 |
| GB | 2479760 | 10/2011 |
| GB | 2482547 | 2/2012 |
| JP | 31-13055 | 8/1956 |
| JP | 35-4369 | 3/1960 |
| JP | 39-7297 | 3/1964 |
| JP | 49-150403 | 12/1974 |
| JP | 51-7258 | 1/1976 |
| JP | 53-1015 | 1/1978 |
| JP | 53-51608 | 5/1978 |
| JP | 53-60100 | 5/1978 |
| JP | 56-167897 | 12/1981 |
| JP | 57-71000 | 5/1982 |
| JP | 57-157097 | 9/1982 |
| JP | 59-90797 | 5/1984 |
| JP | 59-167984 | 11/1984 |
| JP | 60-105896 | 7/1985 |
| JP | 61-31830 | 2/1986 |
| JP | 61-116093 | 6/1986 |
| JP | 61-218824 | 9/1986 |
| JP | 61-280787 | 12/1986 |
| JP | 62-223494 | 10/1987 |
| JP | 63-179198 | 7/1988 |
| JP | 63-306340 | 12/1988 |
| JP | 64-7273 | 2/1989 |
| JP | 64-21300 | 2/1989 |
| JP | 64-83884 | 3/1989 |
| JP | 1-138399 | 5/1989 |
| JP | 1-224598 | 9/1989 |
| JP | 2-146294 | 6/1990 |
| JP | 2-218890 | 8/1990 |
| JP | 2-248690 | 10/1990 |
| JP | 3-3419 | 1/1991 |
| JP | 3-52515 | 5/1991 |
| JP | 3-267598 | 11/1991 |
| JP | 4-43895 | 2/1992 |
| JP | 4-366330 | 12/1992 |
| JP | 5-157093 | 6/1993 |
| JP | 5-164089 | 6/1993 |
| JP | 5-263786 | 10/1993 |
| JP | 6-74190 | 3/1994 |
| JP | 6-86898 | 3/1994 |
| JP | 6-147188 | 5/1994 |
| JP | 6-257591 | 9/1994 |
| JP | 6-280800 | 10/1994 |
| JP | 6-336113 | 12/1994 |
| JP | 7-190443 | 7/1995 |
| JP | 7-247991 | 9/1995 |
| JP | 8-21400 | 1/1996 |
| JP | 9-100800 | 4/1997 |
| JP | 9-287600 | 11/1997 |
| JP | 10-65999 | 3/1998 |
| JP | 10-122188 | 5/1998 |
| JP | 11-227866 | 8/1999 |
| JP | 2000-116179 | 4/2000 |
| JP | 2000-201723 | 7/2000 |
| JP | 2001-17358 | 1/2001 |
| JP | 2001-295785 | 10/2001 |
| JP | 2002-21797 | 1/2002 |
| JP | 2002-138829 | 5/2002 |
| JP | 2002-188593 | 7/2002 |
| JP | 2002-213388 | 7/2002 |
| JP | 2003-274070 | 9/2003 |
| JP | 2003-329273 | 11/2003 |
| JP | 2004-8275 | 1/2004 |
| JP | 2004-208935 | 7/2004 |
| JP | 2004-216221 | 8/2004 |
| JP | 2005-201507 | 7/2005 |
| JP | 2005-307985 | 11/2005 |
| JP | 2006-89096 | 4/2006 |
| JP | 3127331 | 11/2006 |
| JP | 2007-138763 | 6/2007 |
| JP | 2007-138789 | 6/2007 |
| JP | 2008-39316 | 2/2008 |
| JP | 2008-100204 | 5/2008 |
| JP | 3146538 | 10/2008 |
| JP | 2008-294243 | 12/2008 |
| JP | 2009-44568 | 2/2009 |
| JP | 2009-264121 | 11/2009 |
| JP | 2010-131259 | 6/2010 |
| JP | 2010-203446 | 9/2010 |
| JP | 2012-36897 | 2/2012 |
| JP | 2012-57619 | 3/2012 |
| KR | 2002-0061691 | 7/2002 |
| KR | 2002-0067468 | 8/2002 |
| KR | 10-2005-0102317 | 10/2005 |
| KR | 10-0576107 | 4/2006 |
| KR | 2007-0007997 | 1/2007 |
| KR | 10-2010-0055611 | 5/2010 |
| KR | 2000-0032363 | 6/2010 |
| KR | 10-0985378 | 9/2010 |
| TW | M394383 | 12/2010 |
| TW | M407299 | 7/2011 |
| WO | WO-90/13478 | 11/1990 |
| WO | WO-02/073096 | 9/2002 |
| WO | WO-03/058795 | 7/2003 |
| WO | WO-03/069931 | 8/2003 |
| WO | WO-2005/050026 | 6/2005 |
| WO | WO 2005/057091 | 6/2005 |
| WO | WO-2006/008021 | 1/2006 |
| WO | WO-2006/012526 | 2/2006 |
| WO | WO-2007/024955 | 3/2007 |
| WO | WO-2007/048205 | 5/2007 |
| WO | WO-2008/014641 | 2/2008 |
| WO | WO-2008/024569 | 2/2008 |
| WO | WO-2009/030879 | 3/2009 |
| WO | WO-2009/030881 | 3/2009 |
| WO | WO-2010/100448 | 9/2010 |
| WO | WO-2010/100451 | 9/2010 |
| WO | WO-2010/100452 | 9/2010 |
| WO | WO-2010/100453 | 9/2010 |

(56) References Cited

FOREIGN PATENT DOCUMENTS

| | | |
|---|---|---|
| WO | WO-2010/100462 | 9/2010 |
| WO | WO-2011/055134 | 5/2011 |

OTHER PUBLICATIONS

Gammack, P. et al., U.S. Office Action mailed Dec. 9, 2010, directed to U.S. Appl. No. 12/203,698; 10 pages.
Gammack, P. et al., U.S. Office Action mailed Jun. 21, 2011, directed to U.S. Appl. No. 12/203,698; 11 pages.
Gammack et al., Office Action mailed Sep. 17, 2012, directed to U.S. Appl. No. 13/114,707; 12 pages.
Gammack, P. et al., U.S. Office Action mailed Dec. 10, 2010, directed to U.S. Appl. No. 12/230,613; 12 pages.
Gammack, P. et al., U.S. Office Action mailed May 13, 2011, directed to U.S. Appl. No. 12/230,613; 13 pages.
Gammack, P. et al., U.S. Office Action mailed Sep. 7, 2011, directed to U.S. Appl. No. 12/230,613; 15 pages.
Gammack, P. et al., U.S. Office Action mailed Jun. 8, 2012, directed to U.S. Appl. No. 12/230,613; 15 pages.
Gammack et al., U.S. Office Action mailed Aug. 20, 2012, directed to U.S. Appl. No. 12/945,558; 15 pages.
Fitton et al., U.S. Office Action mailed Nov. 30, 2010 directed to U.S. Appl. No. 12/560,232; 9 pages.
Nicolas, F. et al., U.S. Office Action mailed Mar. 7, 2011, directed to U.S. Appl. No. 12/622,844; 10 pages.
Nicolas, F. et al., U.S. Office Action mailed Sep. 8, 2011, directed to U.S. Appl. No. 12/622,844; 11 pages.
Fitton, et al., U.S. Office Action mailed Mar. 8, 2011, directed to U.S. Appl. No. 12/716,780; 12 pages.
Fitton, et al., U.S. Office Action mailed Sep. 6, 2011, directed to U.S. Appl. No. 12/716,780; 16 pages.
Gammack, P. et al., U.S. Office Action mailed Dec. 9, 2010, directed to U.S. Appl. No. 12/716,781; 17 pages.
Gammack, P. et al., U.S. Final Office Action mailed Jun. 24, 2011, directed to U.S. Appl. No. 12/716,781; 19 pages.
Gammack, P. et al., U.S. Office Action mailed Nov. 29, 2012, directed to U.S. Appl. No. 12/716,742; 9 pages.
Cookson, M. et al., U.S. Office Action mailed Dec. 19, 2012, directed to U.S. Appl. No. 12/716,778; 8 pages.
Gammack, P. et al., U.S. Office Action mailed Apr. 12, 2011, directed to U.S. Appl. No. 12/716,749; 8 pages.
Gammack, P. et al., U.S. Office Action mailed Sep. 1, 2011, directed to U.S. Appl. No. 12/716,749; 9 pages.
Gammack, P. et al., U.S. Office Action mailed Jun. 25, 2012, directed to U.S. Appl. No. 12/716,749; 11 pages.
Fitton et al., U.S. Office Action mailed Mar. 30, 2012, directed to U.S. Appl. No. 12/716,707; 7 pages.
Gammack, P. et al., U.S. Office Action mailed May 24, 2011, directed to U.S. Appl. No. 12/716,613; 9 pages.
Reba, I. (1966). "Applications of the Coanda Effect," *Scientific American* 214:84-92.
Third Party Submission Under 37 CFR 1.99 filed Jun. 2, 2011, directed towards U.S. Appl. No. 12/203,698; 3 pages.
Gammack et al., U.S. Office Action mailed Jun. 9, 2014, directed to U.S. Appl. No. 13/314,974; 9 pages.
Gammack et al., U.S. Office Action mailed Jan. 7, 2013, directed to U.S. Appl. No. 12/716,749; 16 pages.
Gammack et al., U.S. Office Action mailed Nov. 2, 2012, directed to U.S. Appl. No. 13/314,974; 8 pages.
Gammack et al., U.S. Office Action mailed Jun. 6, 2013, directed to U.S. Appl. No. 13/314,974; 7 pages.
Gammack et al., U.S. Office Action mailed Nov. 2, 2012, directed to U.S. Appl. No. 13/284,516; 9 pages.
Hodgson et al., U.S. Office Action mailed Mar. 24, 2014, directed to U.S. Appl. No. 13/207,212; 10 pages.

* cited by examiner

FAN ASSEMBLY

REFERENCE TO RELATED APPLICATIONS

This application claims the priority of United Kingdom Application No. 1212323.8, filed Jul. 11, 2012, the entire contents of which are incorporated herein by reference.

FIELD OF THE INVENTION

The present invention relates to a fan assembly and a stand for a fan assembly.

BACKGROUND OF THE INVENTION

A conventional domestic fan typically includes a set of blades or vanes mounted for rotation about an axis, and drive apparatus for rotating the set of blades to generate an air flow. The movement and circulation of the air flow creates a 'wind chill' or breeze and, as a result, the user experiences a cooling effect as heat is dissipated through convection and evaporation.

Some fans, such as that described in U.S. Pat. No. 5,609,473, provide a user with an option to adjust the direction in which air is emitted from the fan. In U.S. Pat. No. 5,609,473, the fan comprises a base and a pair of yokes each upstanding from a respective end of the base. The outer body of the fan houses a motor and a set of rotating blades. The outer body is secured to the yokes so as to be pivotable relative to the base. The fan body may be swung relative to the base from a generally vertical, untilted position to an inclined, tilted position. In this way the direction of the air flow emitted from the fan can be altered.

WO 2010/100451 describes a fan assembly which does not use caged blades to project air from the fan assembly. Instead, the fan assembly comprises a cylindrical stand which houses a motor-driven impeller for drawing a primary air flow into the stand, and an annular nozzle connected to the stand and comprising an annular air outlet through which the primary air flow is emitted from the fan. The nozzle defines a central opening through which air in the local environment of the fan assembly is drawn by the primary air flow emitted from the air outlet, amplifying the primary air flow.

The stand comprises a base and a body mounted on the base. The body houses the motor-driven impeller. The body is secured to the base so that that body can be moved relative to the base from an untilted position to a tilted position by pushing or sliding the body relative to the base. The base has a concave upper surface upon which are mounted a plurality of L-shaped rails for retaining the body on the base, and for guiding the sliding movement of the body relative to the base as it is moved to or from a tilted position. The body has a convex lower surface upon which a convex tilt plate is mounted. The tilt plate comprises a plurality of L-shaped runners which interlock with the rails on the base as the tilt plate is secured to the base so that flanges of the runners are located beneath conformingly shaped flanges of the rails.

The base further comprises a plurality of support members for supporting the body on the base. Each support member comprises a ball bearing and a spring which urges the ball bearing away from the support. The tilt plate comprises curved races for receiving the bearings and within which the bearings move as the body is tilted relative to the base. The spring force of the springs urges the body away from the base, against the weight of the body, nozzle and internal components of the body, which in turn urges together facing surfaces of the flanges of the rails and the runners so that the body is maintained in a desired tilted position by virtue of friction between the rails and the runners.

A problem associated with this mechanism for maintaining the body in a tilted position relative to the base is that, depending on the material from which the springs are formed, relaxation of the springs over time can cause the body to move gradually closer to the base, reducing the friction forces between the rails and the runners. If this relaxation is severe, this can compromise the ability of the mechanism to maintain the body in a tilted position.

SUMMARY OF THE INVENTION

In a first aspect the present invention provides a fan assembly comprising a base; a body mounted on the base for movement relative thereto between an untilted position and a tilted position, the body comprising at least one air inlet, an impeller and a motor for driving the impeller to draw an air flow through said at least one air inlet; at least one air outlet; an interior passage for conveying air to said at least one air outlet, the interior passage extending about an opening through which air from outside the fan assembly is drawn by air emitted from said at least one air outlet; a brake connected to the base for movement relative thereto; a stop member connected to the base; a section of the body being disposed between the brake and the stop member; and means for urging the brake towards the stop member to urge the section of the body against the stop member to maintain the body in a tilted position relative to the base by means of friction between the section of the body and the stop member.

The present invention thus replaces the support members of the base of the fan assembly of WO 2010/100451 with a brake and a stop member connected to the base, with a section of the body being located between the brake and the stop member. The brake and the stop member are preferably located on the upper surface of the base. The brake is preferably mounted on the upper surface of the base, or on features connected to the upper surface of the base, for sliding movement relative to the upper surface of the base. The stop member may protrude upwardly from, and may be integral with, the upper surface of the base. The section of the body is preferably connected to a lower surface of the body. The brake is biased toward the stop member so that the section of the body is pushed by the brake against the stop member. The pushing of the section of the body against the stop member generates friction forces of sufficient magnitude to resist movement of the section of the body relative to the stop member, and thus resist movement of the body relative to the base. As the brake is not required to support the weight of the body and its internal components, the degree of relaxation of the spring over the lifetime of the fan assembly can be relatively low, and so the variation in the friction forces generated between the body and the base over the lifetime of the fan assembly can be relatively low.

The body is preferably slidable relative to the base between the untilted position and the tilted position. This can enable the body to be easily moved relative to the base, for example by either pushing or pulling the body relative to the base, between the tilted and untilted positions. In a preferred embodiment, the brake is moveable relative to the base in a direction which is substantially orthogonal to the direction of the tilting, or sliding, movement of the body relative to the base. This direction is preferably substantially orthogonal to an axis of rotation of the impeller when the body is in the untilted position, and is preferably a horizontal direction when the fan assembly is located on a horizontal surface.

One or more components may be provided between the brake and the section of the body, and one of these components may engage the section of the body to urge it towards the stop member. However, in a preferred embodiment the brake is arranged to engage directly the section of the body.

The section of the body preferably comprises a first side surface and a second side surface located opposite to the first side surface. The brake is preferably configured to engage the first side surface and the stop member is preferably configured to engage the second side surface. The parts of the first side surface and the second side surface which are engaged by the brake and the stop member respectively over the range of the tilting movement of the body relative to the base are preferably substantially parallel so that there is substantially no variation in the frictional force generated between the body and the base over the range of tilting movement. The side surfaces are preferably parallel over substantially the entire length of the moveable member. In a preferred embodiment, the stop member comprises a first rail, and the section of the body comprises a second rail extending substantially parallel to the first rail. Preferably, each rail extends in a direction which is parallel to the direction of movement of the body relative to the base. The first rail is preferably upstanding from the upper surface of the base, and the second rail preferably depends from a lower surface of the body.

Preferably, the fan assembly comprises an interface between the base and the body, and at least the outer surfaces of the base and the body which are adjacent to the interface have substantially the same profile. The interface preferably has a curved, more preferably undulating, outer periphery. Facing surfaces of the base and the body are preferably conformingly curved. The base preferably has a curved upper surface, whereas the body preferably has a conformingly curved lower surface. For example the upper surface of the base may be convex, whereas the lower surface of the body may be concave. Each rail is preferably curved, and is preferably arcuate in shape.

In a preferred embodiment the outer surfaces of the base and the body have substantially the same profile. For example, the profile of the outer surfaces of the base and the body may be substantially circular, elliptical, or polyhedral.

The brake and rails are preferably enclosed by the outer surfaces of the base and the body when the body is in the untilted position. This can enable the fan assembly to have a tidy and uniform appearance, and can inhibit the ingress of dust and dirt between the rails which could otherwise reduce the friction between the rails.

The brake is preferably connected to the upper surface of the base. The base preferably comprises means for inhibiting movement of the brake away from the upper surface of the base. This can ensure that the brake is not moved relative to the upper surface of the base as the body is moved relative to the base so that there is no variation in the direction of the force applied to the second rail by the brake. The means for inhibiting movement of the brake away from the upper surface of the base preferably comprises a plurality of guide rails connected to the upper surface of the base, with the brake being secured to the guide rails for sliding movement along the guide rails. The brake preferably comprises a pair of side arms which each extend over and partially about a respective guide rail. The guide rails are preferably aligned orthogonally to the first and second rails.

The fan assembly preferably comprises a seat connected to the base, with the means for urging the brake towards the stop member being located between the seat and the brake. The seat is preferably connected to the upper surface of the base. The means for urging the brake towards the stop member preferably comprises a spring, although any other resilient element may be provided between the seat and the brake.

The fan assembly preferably comprises means for indicating to the user, as the body is moved relative to the base, that the body is in the untilted position. The indicating means is preferably arranged to provide a variation in the force, more preferably a reduction in the force, required to move the body relative to the base as the body moves into the untilted position. For example, the section of the body may comprise a recess, which is located on the first side surface of the section of the body which faces the brake. Part of the brake is preferably located within the recess when the body is in the untilted position. The movement of the brake into the recess as the body is moved towards the untilted position can be identified by the user through a sudden reduction in the force required to move the body relative to the base, due to a relaxation of the spring or other means for urging the brake towards the stop member. This can provide an indication to the user that the body in its untilted position relative to the base.

The body preferably comprises a plate connected to a lower surface of the body. The, or each, rail of the body preferably forms part of this plate. The plate is preferably connected to a recessed portion of the body so that a side wall of the body surrounds the outer periphery of the plate.

The fan assembly preferably comprises a plurality of pairs of interlocking members for retaining the body on the base. Each pair of interlocking members preferably comprises a first interlocking member located on the base and a second interlocking member located on the body and which is retained by the first interlocking member. The brake and the rails are preferably located between the pairs of interlocking members. Each of the interlocking members preferably comprises a curved flange which extends in the direction of movement of the body relative to the base. The flanges of each pair of interlocking members preferably have substantially the same curvature. During assembly, the flange of the second interlocking member is slid beneath the flange of the first interlocking member so that the flange of the first interlocking member prevents the body from being lifted from the base. Where the body comprises a plate, the second interlocking members are preferably connected to or otherwise form part of that plate. During assembly, the flanges of the second interlocking members are slid beneath the flanges of the first interlocking members before the plate is secured to the lower surface of the body.

The body preferably comprises means for inhibiting the movement of the body relative to the base beyond a fully tilted position. This also prevents the flanges of the second interlocking members from becoming separated from the flanges of the first interlocking members. The movement inhibiting means preferably comprises a stop member for engaging part of the base when the body is in the fully tilted position. In the preferred embodiment the stop member is arranged to engage a flange of a first interlocking member of the base to inhibit movement of the body relative to the base beyond the fully tilted position. The stop member may be provided by part of the side wall of the body which surrounds the outer periphery of the plate.

The base preferably comprises control means for controlling the fan assembly. For safety reasons and ease of use, it can be advantageous to locate control elements away from the tiltable body so that the control functions, such as, for example, oscillation, lighting or activation of a speed setting, are not activated during a tilt operation.

The interior passage and the at least one air outlet of the fan assembly are preferably defined by a nozzle mounted on or connected to the body. The base and the body thus may together provide a stand upon which the nozzle is mounted. The at least one air outlet may be located at or towards the front end of the nozzle. Alternatively, the at least one air outlet may be located towards the rear end of the nozzle. The nozzle may comprise a single air outlet or a plurality of air outlets. In one example, the nozzle comprises a single, annular air outlet extending about the opening, and this air outlet may be circular in shape, or otherwise have a shape which matches the shape of the front end of the nozzle. The interior passage preferably comprises a first section and a second section each for receiving a respective portion of an air flow entering the interior passage, and for conveying the portions of the air flow in opposite angular directions about the opening. Each section of the interior passage may comprise a respective air outlet. The nozzle is preferably substantially symmetrical about a plane passing through the centre of the nozzle. For example, the nozzle may have a generally circular, elliptical or "race-track" shape, in which each section of the interior passage comprises a relatively straight section located on a respective side of the bore. Where the nozzle has a race track shape each straight section of the nozzle may comprise a respective air outlet. The, or each, air outlet is preferably in the form of a slot. The slot preferably has a width in the range from 0.5 to 5 mm.

In a second aspect the present invention provides a stand for a fan assembly, the stand comprising a base; a body mounted on the base for movement relative thereto between an untilted position and a tilted position, the body comprising at least one air inlet, an impeller, a motor for driving the impeller to draw an air flow through said at least one air inlet, and an air outlet; a brake connected to the base for movement relative thereto; a stop member connected to the base; a section of the body being disposed between the brake and the stop member; and means for urging the brake towards the stop member to urge the section of the body against the stop member to maintain the body in a tilted position relative to the base by means of friction between the section of the body and the stop member.

Features described above in connection with the first aspect of the invention are equally applicable to the second aspect of the invention, and vice versa.

BRIEF DESCRIPTION OF THE INVENTION

An embodiment of the present invention will now be described, by way of example only, with reference to the accompanying drawings, in which.

Figure 9:
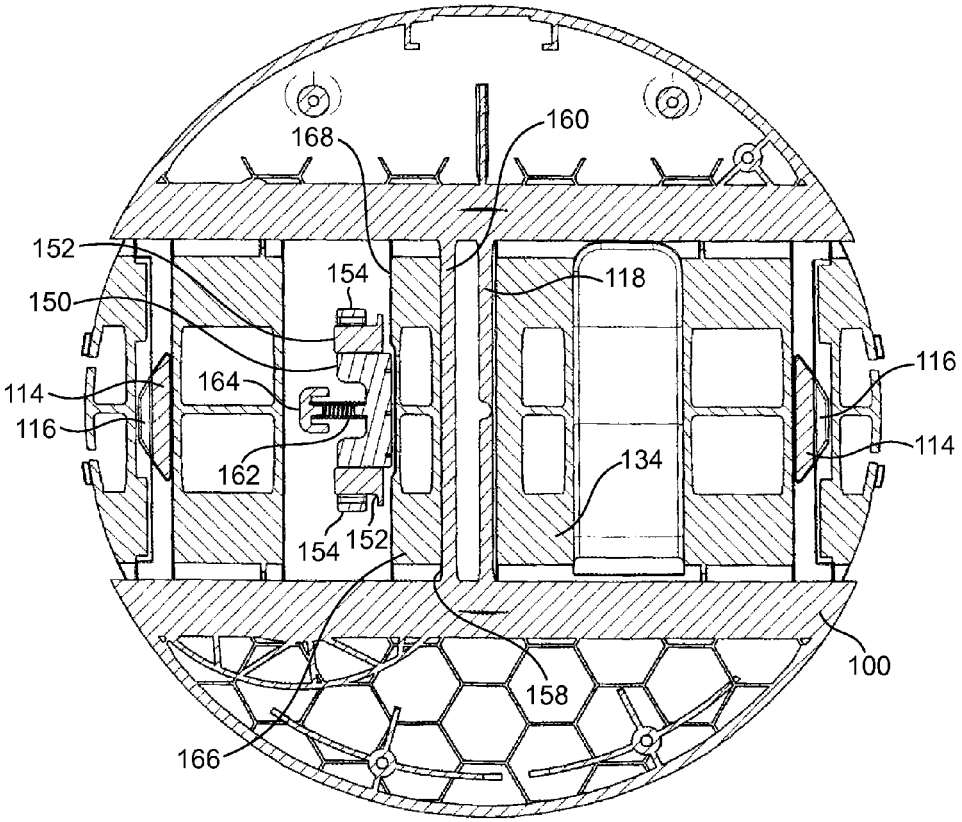
FIG. 9 is a top sectional view taken along line Z-Z in FIG. 8(*a*)
Figure 10:
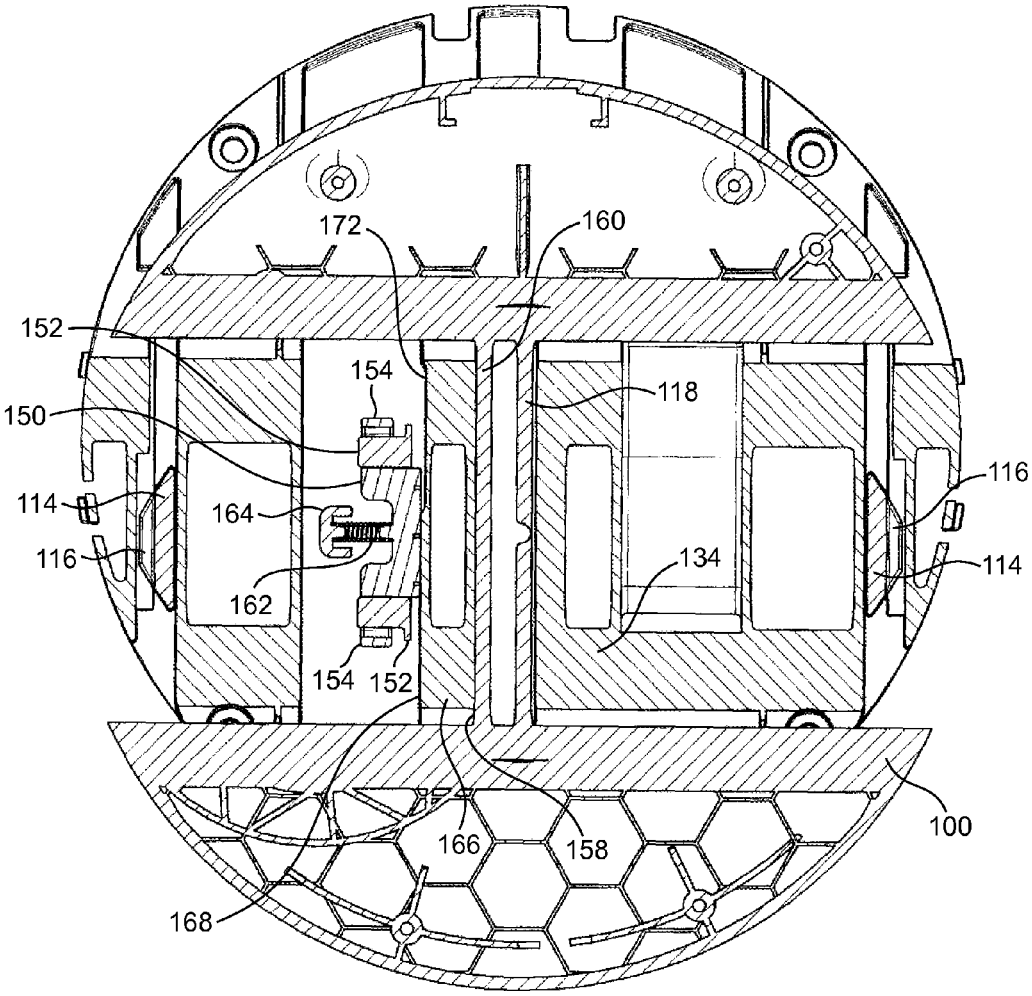
Figure 11:
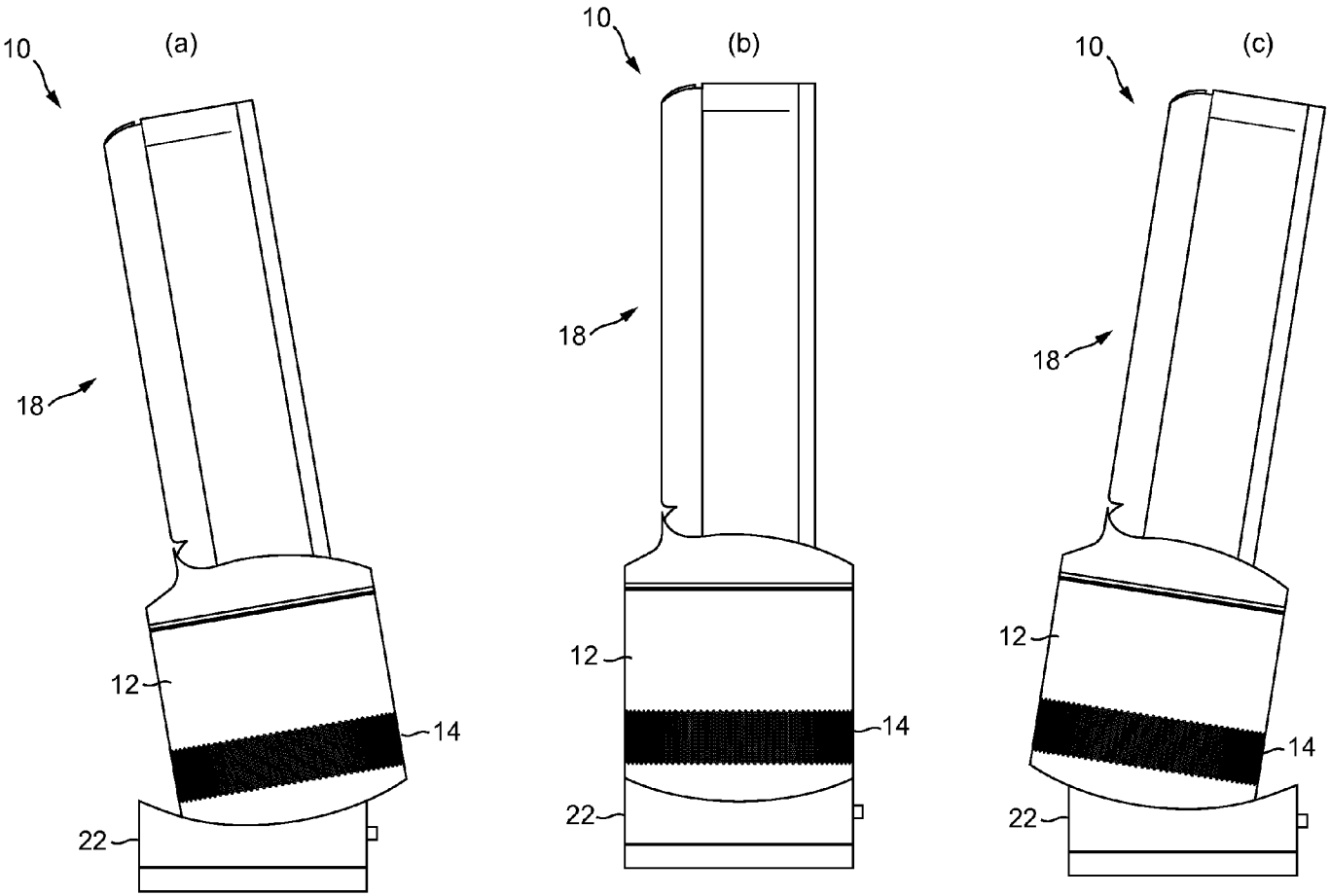

FIG. 10 is a similar view to FIG. 9, but with the tilt plate in a tilted position relative to the base; and FIG. 11(*a*) is a side view of the fan assembly with the body in a first fully tilted position relative to the base, FIG. 11(*b*) is a side view of the fan assembly with the body in an untilted position relative to the base, and FIG. 11(*c*) is a side view of the fan assembly with the body in a second fully tilted position relative to the base.

DETAILED DESCRIPTION OF THE INVENTION

Figure 1:
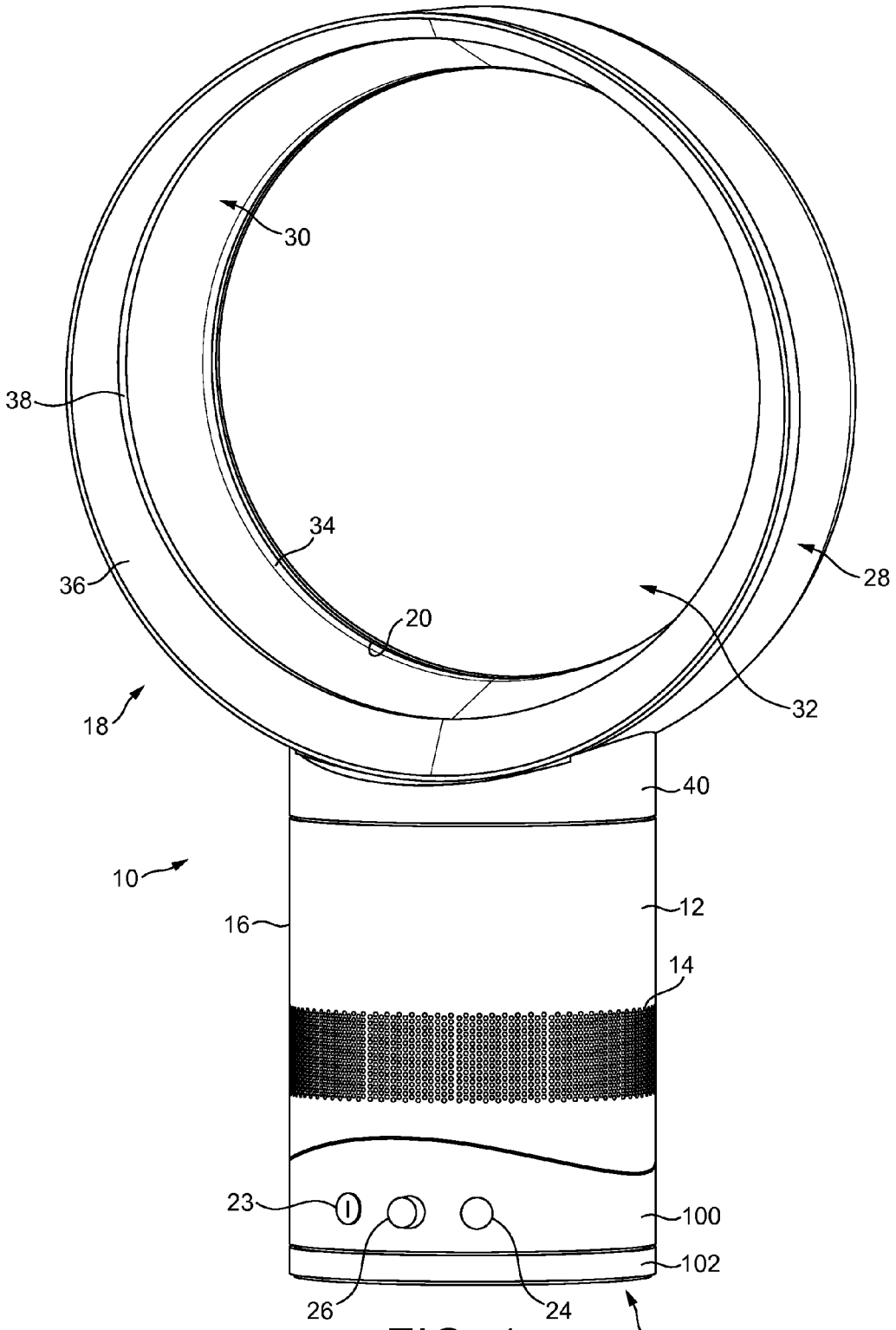
FIG. 1 is a front perspective view of a fan assembly.

FIG. 1 is an external view of a fan assembly 10. The fan assembly 10 comprises a body 12 having an air inlet 14 in the form of a plurality of apertures formed in the outer casing 16 of the body 12, and through which a primary air flow is drawn into the body 12 from the external environment. An annular nozzle 18 having an air outlet 20 for emitting the primary air flow from the fan assembly 10 is connected to the upper end of the body 12. The body 12 is mounted on a base 22 so as to allow the body 12 to tilt relative to the base 22. The base 22 comprises a user interface for allowing a user to control the operation of the fan assembly 10. In this embodiment, the user interface comprises a plurality of user-operable buttons 23, 24 and a user-operable dial 26.

Figure 2:
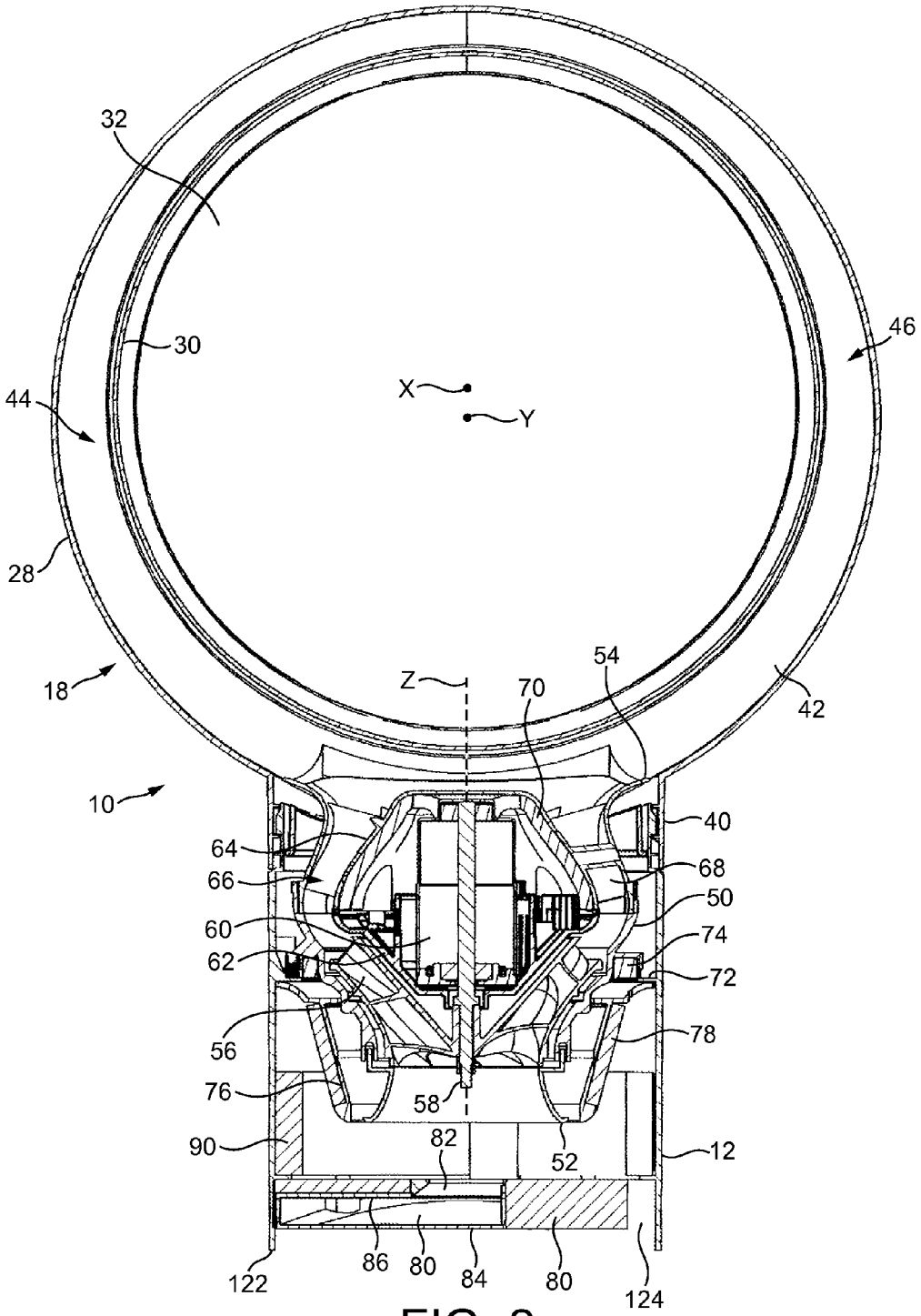
FIG. 2 is a front sectional view through the body and the nozzle of the fan assembly.
Figure 3:
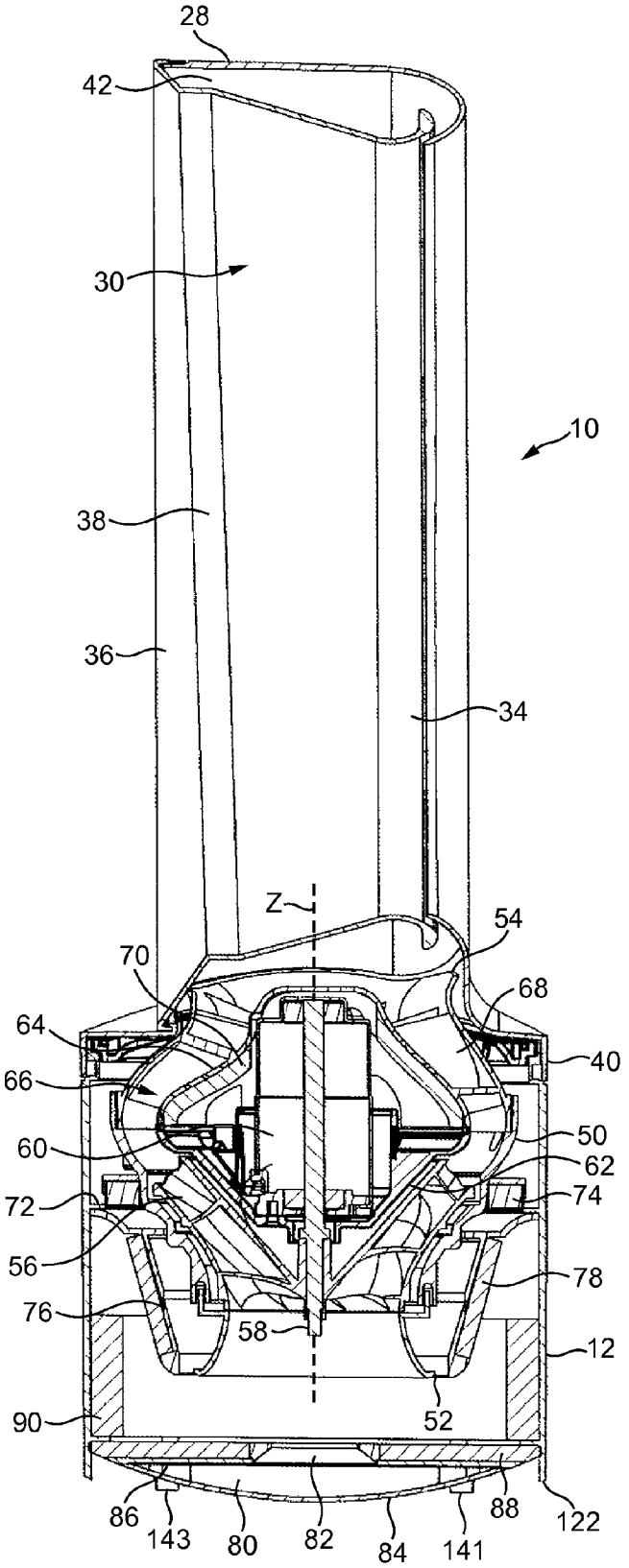
FIG. 3 is a left side sectional view through the body and the nozzle of the fan assembly.

The nozzle 18 has an annular shape. With reference also to FIGS. 2 and 3, the nozzle 18 comprises an outer wall 28 extending about an annular inner wall 30. In this example, each of the walls 28, 30 is formed from a separate component. Each of the walls 28, 30 has a front end and a rear end. The rear end of the outer wall 28 curves inwardly towards the rear end of the inner wall 30 to define a rear end of the nozzle 18. The front end of the inner wall 30 is folded outwardly towards the front end of the outer wall 28 to define a front end of the nozzle 18. The front end of the outer wall 28 is inserted into a slot located at the front end of the inner wall 30, and is connected to the inner wall 30 using an adhesive introduced to the slot.

The inner wall 30 extends about an axis, or longitudinal axis, X to define a bore, or opening, 32 of the nozzle 18. The bore 32 has a generally circular cross-section which varies in diameter along the axis X from the rear end of the nozzle 18 to the front end of the nozzle 18.

The inner wall 30 is shaped so that the external surface of the inner wall 30, that is, the surface that defines the bore 32, has a number of sections. The external surface of the inner wall 30 has a convex rear section 34, an outwardly flared frusto-conical front section 36 and a cylindrical section 38 located between the rear section 34 and the front section 36.

The outer wall 28 comprises a base 40 which is connected to an open upper end of the body 12, and which has an open lower end which provides an air inlet for receiving the primary air flow from the body 12. The majority of the outer wall 28 is generally cylindrical shape. The outer wall 28 extends about a central axis, or longitudinal axis, Y which is parallel to, but spaced from, the axis X. In other words, the outer wall 28 and the inner wall 30 are eccentric. In this example, the axis X is located above the axis Y, with each of the axes X, Y being located in a plane which extends vertically through the centre of the fan assembly 10.

The rear end of the outer wall 28 is shaped to overlap the rear end of the inner wall 30 to define the air outlet 20 of the nozzle 18 between the inner surface of the outer wall 28 and the outer surface of the inner wall 30. The air outlet 20 is in the form of a generally circular slot centred on, and extending about, the axis X. The width of the slot is preferably substantially constant about the axis X, and is in the range from 0.5 to 5 mm. The overlapping portions of the outer wall 28 and the inner wall 30 are substantially parallel, and are arranged to direct air over the convex rear section 34 of the inner wall 30, which provides a Coanda surface of the nozzle 18. A series of angularly spaced spacers may be provided on one of the facing surfaces of the overlapping portions of the outer wall 28 and the inner wall 30 to engage the other facing surface to maintain a regular spacing between these facing surfaces.

The outer wall 28 and the inner wall 30 define an interior passage 42 for conveying air to the air outlet 20. The interior passage 42 extends about the bore 32 of the nozzle 18. In view of the eccentricity of the walls 28, 30 of the nozzle 18, the cross-sectional area of the interior passage 42 varies about the bore 32. The interior passage 42 may be considered to comprise first and second curved sections 44, 46 which each extend in opposite angular directions about the bore 32. Each curved section 44, 46 of the interior passage 42 has a cross-sectional area which decreases in size about the bore 32.

The body 12 and the base 22 are preferably formed from plastics material. The body 12 and the base 22 preferably have substantially the same external diameter so that the external surface of the body 12 is substantially flush with the external surface of the base 22 when the body 12 is in an untilted position relative to the base 22.

The body 12 comprises the air inlet 14 through which the primary air flow enters the fan assembly 10. In this embodiment the air inlet 14 comprises an array of apertures formed in the section of the outer casing 16 of the body 12. Alternatively, the air inlet 14 may comprise one or more grilles or meshes mounted within windows formed in the outer casing 16. The body 12 is open at the upper end (as illustrated) for connection to the base 40 of the nozzle 18, and to allow the primary air flow to be conveyed from the body 12 to the nozzle 18.

The body 12 comprises a duct 50 having a first end defining an air inlet 52 of the duct 50 and a second end located opposite to the first end and defining an air outlet 54 of the duct 50. The duct 50 is aligned within the body 12 so that the longitudinal axis of the duct 50 is collinear with the longitudinal axis of the body 12, and so that the air inlet 52 is located beneath the air outlet 54.

The duct 50 extends about an impeller 56 for drawing the primary air flow into the body 12 of the fan assembly 10. The impeller 56 is a mixed flow impeller. The impeller 56 comprises a generally conical hub, a plurality of impeller blades connected to the hub, and a generally frusto-conical shroud connected to the blades so as to surround the hub and the blades. The blades are preferably integral with the hub, which is preferably formed from plastics material.

The impeller 56 is connected to a rotary shaft 58 extending outwardly from a motor 60 for driving the impeller 56 to rotate about a rotational axis Z. The rotational axis Z is collinear with the longitudinal axis of the duct 50 and orthogonal to the axes X, Y. In this embodiment, the motor 60 is a DC brushless motor having a speed which is variable in response to user manipulation of the dial 26. The maximum speed of the motor 60 is preferably in the range from 5,000 to 10,000 rpm. The motor 60 is housed within a motor housing. The outer wall of the duct 50 surrounds the motor housing, which provides an inner wall of the duct 50. The walls of the duct 50 thus define an annular air flow path which extends through the duct 50. The motor housing comprises a lower section 62 which supports the motor 60, and an upper section 64 connected to the lower section 62. The shaft 58 protrudes through an aperture formed in the lower section 62 of the motor housing to allow the impeller 56 to be connected to the shaft 58. The motor 60 is inserted into the lower section 66 of the motor housing before the upper section 68 is connected to the lower section 66.

The lower section 62 of the motor housing is generally frusto-conical in shape, and tapers inwardly in a direction extending towards the air inlet 52 of the duct 50. The hub of the impeller 56 has a conical inner surface which has a similar shape to that of a contiguous part of the outer surface of the lower section 62 of the motor housing.

The upper section 64 of the motor housing is generally frusto-conical in shape, and tapers inwardly towards the air outlet 54 of the duct 50. An annular diffuser 66 is located between the outer wall of the duct 50 and the upper section 64 of the motor housing. The diffuser 66 comprises a plurality of blades 68 for guiding the air flow towards the air outlet 54 of the duct 50. The shape of the blades 68 is such that the air flow is also straightened as it passes through the diffuser 66. A cable for conveying electrical power to the motor 60 passes through the outer wall of the duct 50, the diffuser 66 and the upper section 64 of the motor housing. The upper section 64 of the motor housing is perforated, and the inner surface of the upper section 64 of the motor housing is lined with noise absorbing material 70, preferably an acoustic foam material, to suppress broadband noise generated during operation of the fan assembly 10.

The impeller housing 68 is mounted on an annular seat 72 located within the body 12. The seat 72 extends radially inwardly from the inner surface of the outer casing 16 so that an upper surface of the seat 72 is substantially orthogonal to the rotational axis Z of the impeller 56. An annular seal 74 is located between the impeller housing 68 and the seat 72. The annular seal 74 is preferably a foam annular seal, and is preferably formed from a closed cell foam material. The annular seal 74 has a lower surface which is in sealing engagement with the upper surface of the seat 72, and an upper surface which is in sealing engagement with the impeller housing 68. A plurality of resilient supports are also provided between the impeller housing 68 and the seat 72 for bearing part of the weight of the duct 50, the impeller 56, the motor 60, and the motor housing. The resilient supports are equally spaced from, and equally spaced about, the longitudinal axis of the body 12. The seat 72 comprises an aperture to enable the cable (not shown) to pass to the motor 60. The annular seal 74 is shaped to define a recess to accommodate part of the cable. One or more grommets or other sealing members may be provided about the cable to inhibit the leakage of air through the aperture, and between the recess and the internal surface of the outer casing 16.

A guide member 76 is provided about the inlet section 66 and the lower end of the impeller housing 68 for guiding the air flow entering the body 12 towards the air inlet 52 of the duct 50. The guide member 76 is generally frusto-conical in shape, and tapers inwardly towards the base 56 of the body 12. The guide member 76 defines in part a tortuous air flow path between the air inlet 14 of the body 12 and the air inlet 52 of the duct 50, and so serves to block any direct path for noise passing from the air inlet 52 of the duct 50 towards the air inlet 14 of the body 12. The guide member 76 depends from an annular rib extending about the impeller housing 68. The outer periphery of the rib may be connected to the inner surface of the body 12, for example using an adhesive. The outer surface of the guide member 76 which is exposed to the air flow passing through the body 12 is lined with sound-absorbing material 78.

The body 12 comprises a noise suppression cavity 80 located beneath the air inlet 52 of the duct 50. The cavity 80 is also tuned to the wavelength of the rotational tone of the impeller 56. The cavity 80 has an inlet 82 which is located beneath the air inlet 52 of the duct 50, and which is preferably concentric with the air inlet 52 of the duct 50. A lower wall of the cavity 80 is defined by a curved base 84 of the outer casing 16 of the body 12. The inlet 82 and an upper wall of the cavity 80 are defined by an annular plate 86 which is connected to the upper peripheral portion of the base 84.

To reduce the level of broadband noise emitted from the fan assembly 10, an annular sound absorbing member 88 is preferably located between the duct 50 and the cavity 80. The annular sound absorbing member 88 is concentric with the inlet 82 of the cavity 80, and has an outer periphery which is in contact with the inner surface of the outer casing 16. The inner surface of the outer casing 16 is partially lined with sound absorbing material. For example, a sheet of sound-absorbing material 90 may be located immediately downstream of the air inlet 14 to reduce the level of broadband noise emitted through the air inlet 14 of the body 12.

Figure 4:
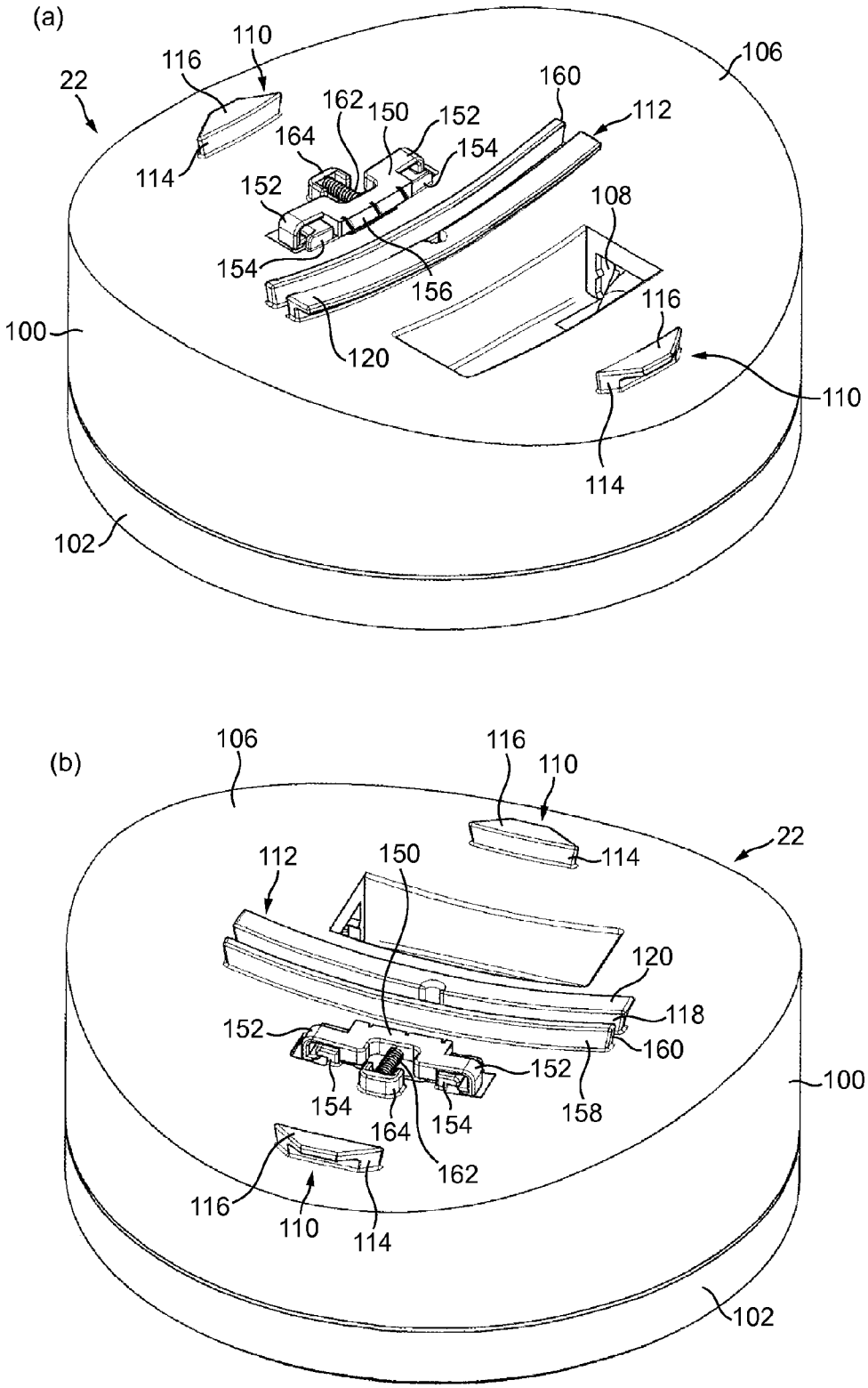
FIG. 4(*a*) is a left perspective view of the base of the fan assembly, and FIG. 4(*b*) is a right perspective view of the base of the fan assembly.

As mentioned above, the body 12 is mounted on a base 22. With reference to FIGS. 4(*a*) and 4(*b*), the base 22 comprises an upper base member 100 mounted on a lower base member 102. The upper base member 100 comprises the aforementioned user interface and a control circuit for controlling various functions of the fan assembly 10 in response to operation of the user interface. The upper base member 100 also houses a mechanism for oscillating the upper base member 100 relative to the lower base member 102. The oscillation mechanism is identified generally at 104 in FIG. 8(*a*). The operation of the oscillation mechanism 104 is controlled by the control circuit in response to the user's depression of the button 24 of the user interface. The range of each oscillation cycle of the upper base member 100 relative to the lower base member 102 is preferably between 60° and 120°, and the oscillation mechanism is arranged to perform around 3 to 5 oscillation cycles per minute. A mains power cable (not shown) for supplying electrical power to the fan assembly 10 extends through an aperture formed in the lower base member 102.

The body 12 is mounted on the base 22 so as to be moveable relative to the base 22 between a first fully tilted position, as illustrated in FIG. 11(*a*) and a second fully tilted position, as illustrated in FIG. 11(*c*). The axes X, Y are preferably inclined by an angle of around 10° as the main body is moved from an untilted position, as illustrated in FIG. 11(*b*) to one of the two fully tilted positions. The outer surfaces of the body 12 and the upper base member 100 are shaped so that adjoining portions of these outer surfaces are substantially flush when the body 12 is in the untilted position.

The body 12 is mounted on the base 22 so that the body 12 is slidable relative to the base 22 as it moves to or from a tilted position. Referring again to FIGS. 4(*a*) and 4(*b*), the upper base member 100 comprises a curved upper surface 106. The curved upper surface 106 is concave in shape, and may be described as generally saddle-shaped. An aperture 108 is formed in the upper surface 106 for receiving an electrical cable extending between the motor 60 and the control circuit.

The upper base member 100 comprises a plurality of first interlocking members which each co-operate with a respective second interlocking member located on the body 12 to retain the body 12 on the upper base member 100. The first interlocking members also serve to guide the movement of the body 12 relative to the upper base member 100 so that there is substantially no twisting or rotation of the body 12 relative to the upper base member 100 as it is moved from or to a tilted position. Each of the first interlocking members extends in the direction of movement of the body 12 relative to the base 22. In this embodiment, the upper base member 100 comprises two, relatively short, outer interlocking members 110, and a single, relatively long inner interlocking member 112 located between the outer interlocking members 110. Each of the outer interlocking members 110 has a cross-section in the form of an inverted L-shape. Each of the outer interlocking members 110 comprises a wall 114 which is connected to, and upstanding from, the upper surface 106 of the upper base member 100, and a curved flange 116 which connected to, and orthogonal to, the upper end of the wall 114. The inner interlocking member 112 also has a cross-section in the form of an inverted L-shape. The inner interlocking member 112 comprises a wall 118 which is connected to, and upstanding from, the upper surface 106 of the upper base member 100, and a curved flange 120 which connected to, and orthogonal to, the upper end of the wall 118.

The body 12 comprises a substantially cylindrical outer casing 16 having an annular lower end 122 and a curved base 84 which is spaced from the lower end 122 of the outer casing 16 to define a recess. The lower surface of the base 84 is convex in shape, and may be described generally as having an inverted saddle-shape. An aperture 124 is formed in the base 84 for allowing the cable to extend into the body 12.

Figure 5:
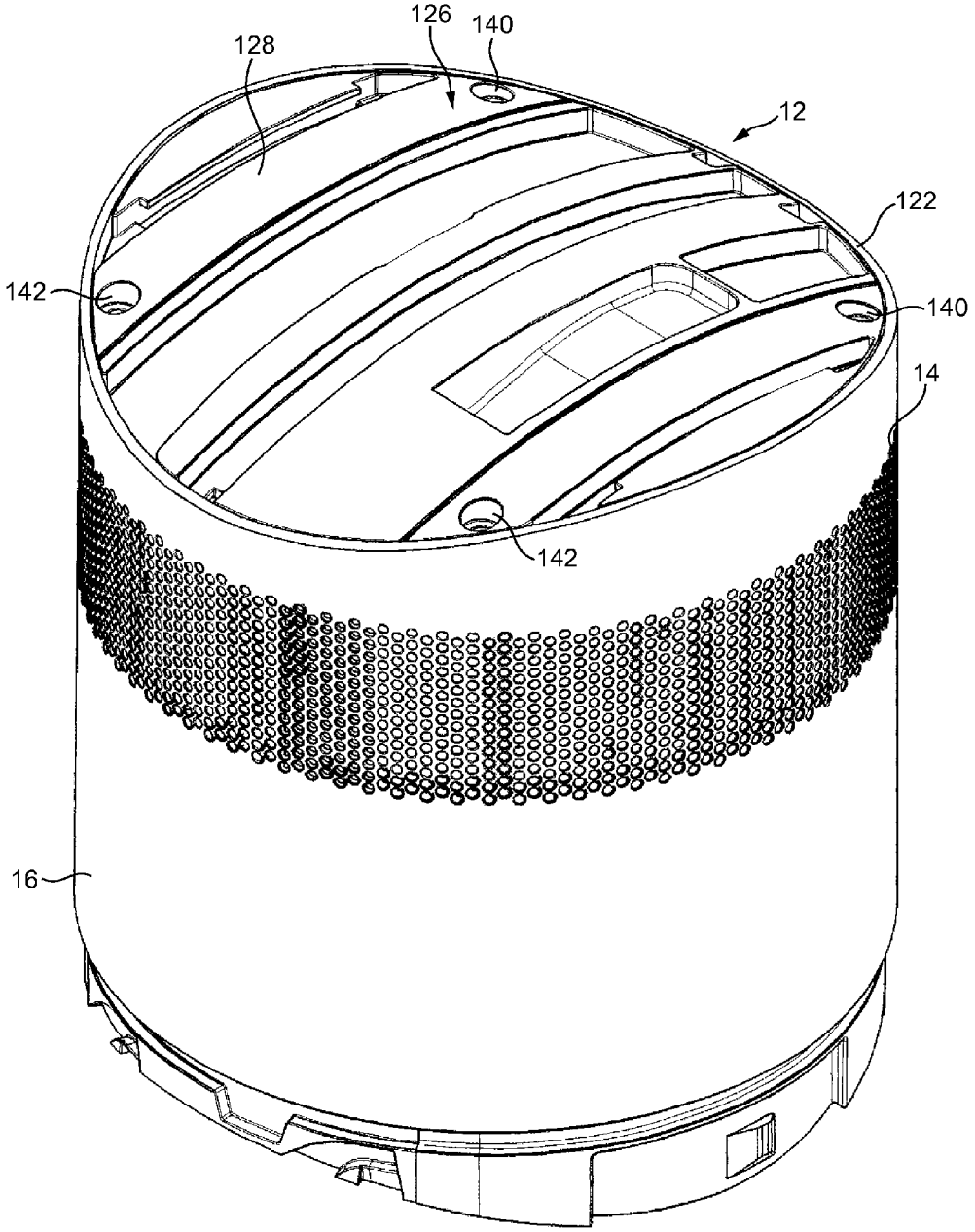
FIG. 5 is a bottom perspective view of the body of the fan assembly.

As illustrated in FIG. 5, a convex tilt plate 126 is connected to the base 84 of the outer casing 16. The tilt plate 126 is located within the recess so that the casing 16 surrounds the outer periphery of the tilt plate 126. The tilt plate 126 has a curvature which is substantially the same as that of the base 84. The tilt plate 126 has a convex lower surface 128. The tilt plate 126 is illustrated in isolation from the outer casing 16 in FIGS. 6(*a*) and 6(*b*). The tilt plate 126 comprises a plurality of second interlocking members which are each retained by a respective first interlocking member of the upper base member 100 to connect the body 12 to the base 22. The tilt plate 126 comprises a plurality of parallel grooves which define a plurality of curved rails of the tilt plate 126. The grooves define a pair of outer rails 128 and a first inner rail 130, and these rails 128, 130 provide the second interlocking members of the body 12. Each of the outer rails 128 comprises a flange 132 which extends into a respective groove of the tilt plate 126, and which has a curvature which is substantially the same as the curvature of the flanges 116 of the upper base member 100. The first inner rail 130 also comprises a flange 134 which extends into a respective groove of the tilt plate 126, and which has a curvature which is substantially the same as the curvature of the flange 120 of the upper base member 100. An aperture (not shown) is formed in the first inner rail 130 for allowing the cable to pass through the tilt plate 126. The lower surface 128 of the tilt plate 126 comprises a plurality of parallel ridges 136 which extend in the direction of tilting movement of the body 12 relative to the base 22, and which engage the upper surface 106 of the upper base member 100 when the tilt plate 126 is slid on to the base 22. This reduces the area of contact between the lower surface 128 of the tilt plate 126 and the upper surface 106 of the upper base member 100, and so reduces frictional forces between the lower surface 128 of the tilt plate 126 and the upper surface 106 of the upper base member 100 as the body 12 is tilted relative to the base 22.

Figure 6:
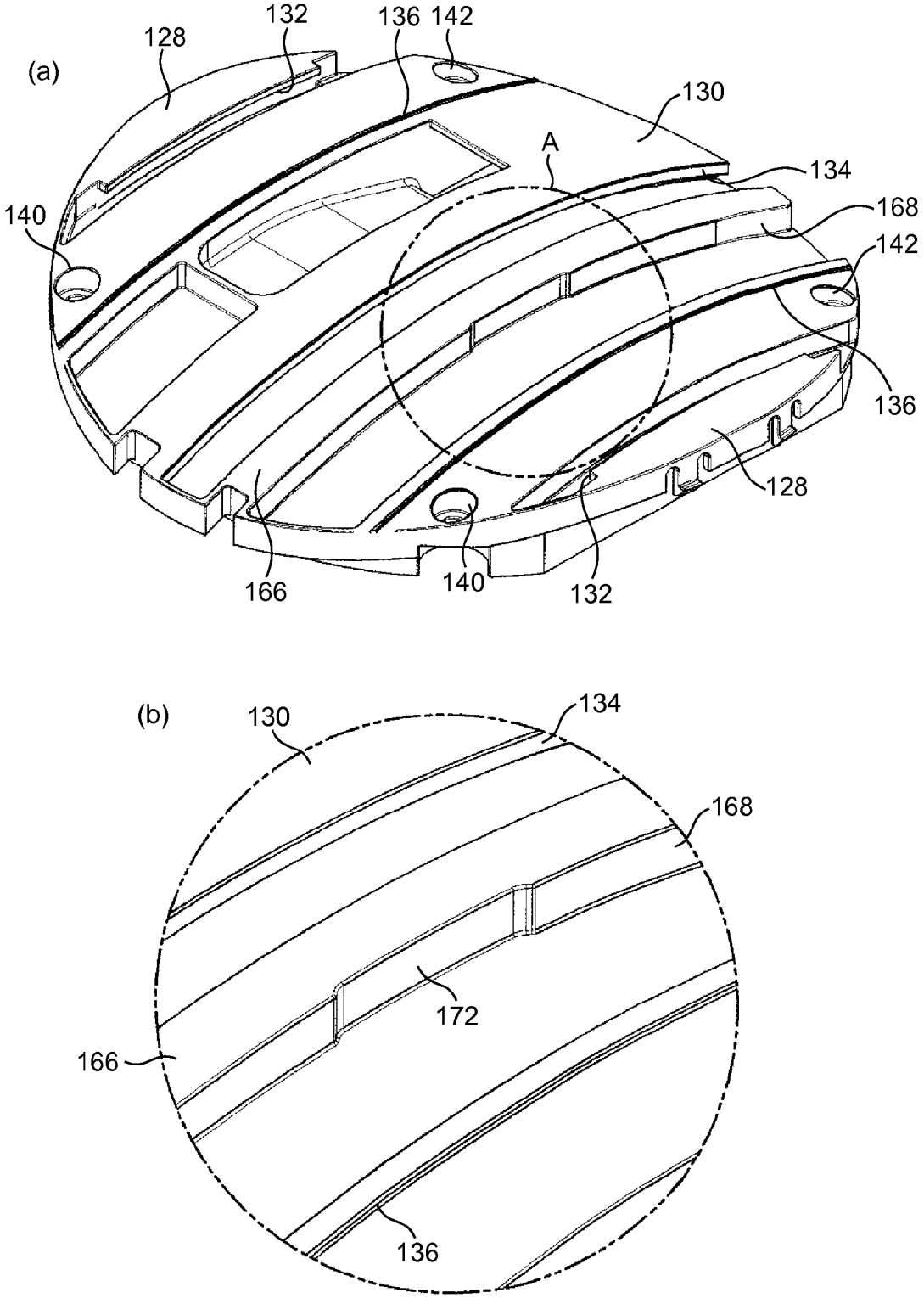
FIG. 6(*a*) is a bottom perspective view of a tilt plate of the body, and FIG. 6(*b*) is a close-up of region A identified in FIG. 6(*a*)
Figure 7:
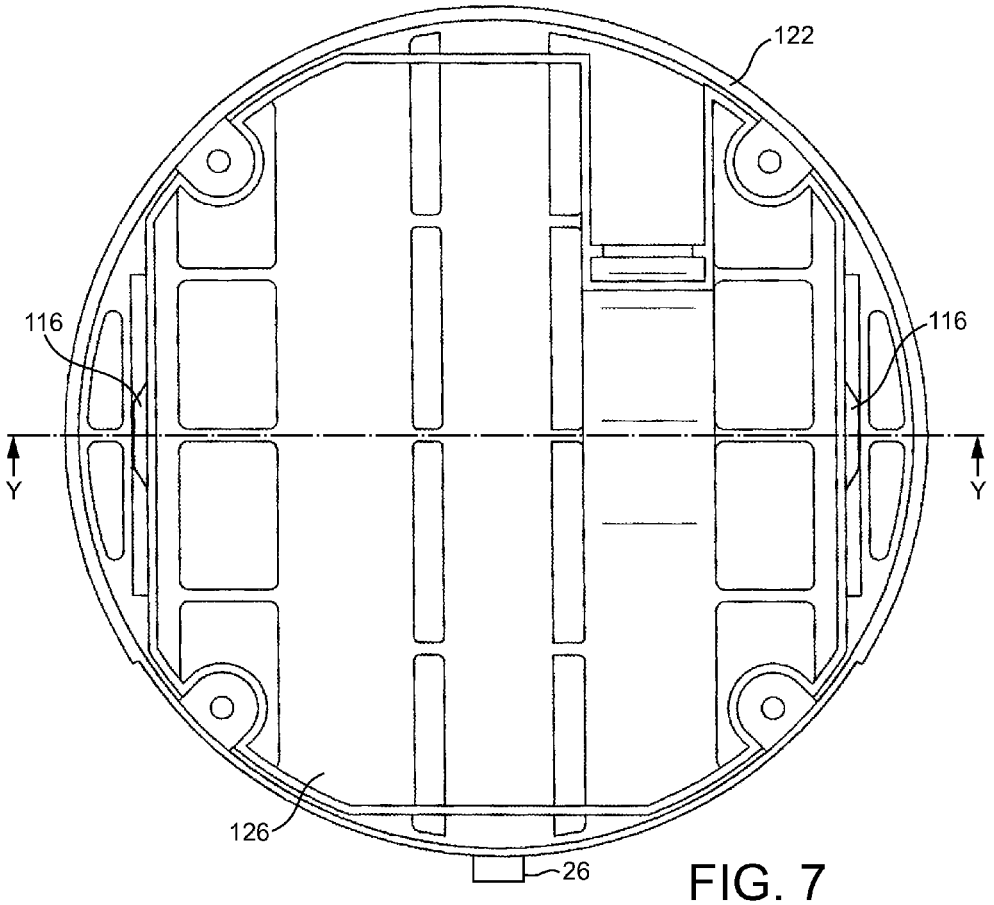
FIG. 7 is a top view of the base of the fan assembly, with the tilt plate attached to the base and in an untilted position relative to the base.

To connect the body 12 to the upper base member 100, the tilt plate 126 is inverted from the orientation illustrated in FIG. 6(*a*). The cable extending through the aperture 124 of the outer casing 16 of the body 12 is fed through the apertures in the tilt plate 126 and the upper base member 100 respectively for subsequent connection to the control circuit within the base 22. The tilt plate 126 is then slid over the upper base member 100 so that the flange 132 of each outer rail 128 is located beneath a respective flange 116 of the upper base member 100, and so that the flange 134 of the first inner rail 130 is located beneath the flange 120 of the upper base member 100. FIG. 7 is an external view of the base 22 when the tilt plate 126 has been slid fully on to the base 22.

With the tilt plate 126 positioned centrally on the upper base member 100, the body 12 is lowered on to the tilt plate 126 so that tilt plate 126 is housed within the recess of the outer casing of the body 12. The upper base member 100 and the body 12 are then inverted, and the body 12 is tilted relative to the base 22 to reveal a first plurality of apertures 140 located on the tilt plate 126. Each of these apertures 140 is aligned with a respective tubular protrusion 141 (one of which is shown in FIG. 3) on the base 84 of the outer casing 16 of the body 12. A self-tapping screw is screwed into each of the apertures 140 to enter the underlying protrusion 141, thereby partially connecting the tilt plate 126 to the body 12. The body 12 is then tilted in the reverse direction to reveal a second plurality of apertures 142 located on the tilt plate 126. Each of these apertures 142 is also aligned with a tubular protrusion 143 (one of which is shown in FIG. 3) on the base 84 of the outer casing 16 of the body 12. A self-tapping screw is screwed into each of the apertures 142 to enter the underlying protrusion 143 to complete the connection of the tilt plate 126 to the body 12. As the body 12 is tilted relative to the base 22, engagement between each of the flanges 116, 120 of the base 22 with a respective portion of the inner wall of the outer wall 16 which defines the recess in which the tilt plate 126 is located prevents the tilt plate 126 from sliding free from the base 22.

The fan assembly 10 includes a mechanism for retaining the body 12 in a desired tilted position relative to the base 22. This mechanism will now be described with reference to FIGS. 4(*a*), 4(*b*), and 6(*a*) to 10.

Referring first to FIGS. 4(*a*) and 4(*b*), the upper base member 100 comprises a brake 150 which is moveable relative to the upper base member 100. The brake 150 comprises a pair of side arms 152 which each extends over and partially about a respective guide rail 154 formed on the upper base member 100. The guide rails 154 are parallel, and extend in a direction which is orthogonal both to the walls 114, 118, and to the direction in which the body 12 moves relative to the base 22. The brake 150 is secured to the guide rails 154 in a snap-fit connection which allows the brake 150 to move along the guide rails 154 in a direction which is parallel to the guide rails 154. The brake 150 comprises a plurality of brake pads 156. The pads 156 may be secured to the brake 150, or they may be integral with the brake 150. The pads 156 are located on a surface of the brake 150 which faces a side surface 158 of a stop member 160. In this embodiment, the stop member 160 is in the form of a rail which is connected to, and is preferably integral with, the upper surface 106 of the upper base member 100. The stop member extends in a direction which is parallel to the walls 114, 118 of the upper base member 100. The brake 150 is urged towards the stop member 160 by a spring 162 or other resilient element. The spring 162 is located between the brake 150 and a seat 164 connected to, and preferably integral with, the upper surface 106 of the upper base member 100.

Figure 8A:
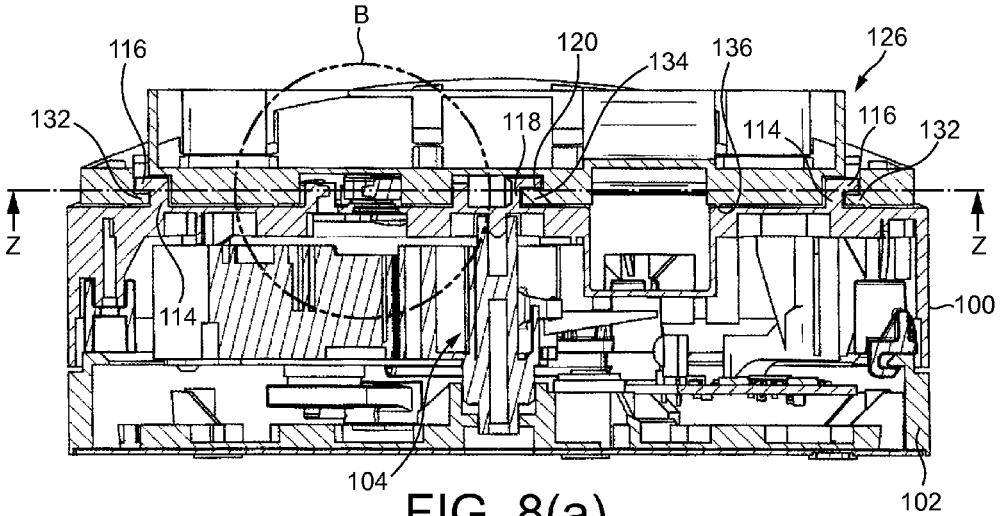
FIG. 8(*a*) is a front sectional view of the base and the tilt plate taken along line Y-Y in FIG. 7, and FIG. 8(*b*) is a close-up of region B identified in FIG. 8(*a*)
Figure 8B:
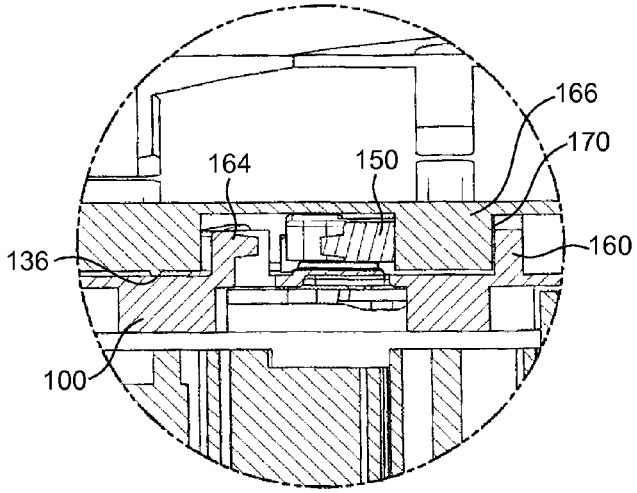

With reference to FIGS. 8(*a*), 8(*b*) and FIGS. 9 and 10, as the tilt plate 126 is slid on to the upper base member 100 a section of the tilt plate 126 slides between the brake 150 and the stop member 160. In this embodiment, a second inner rail 166 of the tilt plate 126 slides between the brake 150 and the stop member 160. The second inner rail 166 also extends in the direction of the tilting movement of the body 12 relative to the base 22, and has a first side surface 168 and a second side surface 170 which is parallel to the first side surface 168. The pads 156 of the brake 150 engage the first side surface 168 of the second inner rail 166, which causes the second side surface 170 to be pushed against the side surface 158 of the stop member 160. FIG. 10 illustrates the relative positions of the base 22 and the tilt plate 126 when the body 12 is in a tilted position relative to the base 22. The spring constant of the spring 162 is selected such that the friction forces generated between the side surface 158 of the stop member 160 and the second side surface 170 of the second inner rail 166 as the brake 150 urges, under the force of the spring 162, these surfaces together is sufficient to hold the body 12 in a tilted position relative to the base 22 against the action of the weight of the body 12 and the nozzle 18 connected to the body 12.

Returning to FIGS. 6(*a*) and 6(*b*), a recess 172 is provided on the first side surface 168 of the second inner rail 166. The recess 172 is shaped to accommodate at least the part of the brake pads 156 of the brake 150. In the tilted position of the tilt plate 126, and therefore the body 12, relative to the base 22 which is illustrated in FIG. 10, the brake pads 156 are spaced from the recess 172. As the tilt plate 126, and therefore the body 12, moves towards the untilted position illustrated in FIG. 9, the brake pads 156 slide along the first side surface 168 of the second inner rail 166. The decrease in the force required to move the body 12 relative to the base 22 as the brake pads 156 enter the recess 172 can allow the user to identify that the body 12 has been moved to its untilted position.

To operate the fan assembly 10 the user presses button 23 of the user interface, in response to which the control circuit in the base 22 activates the motor 60 to rotate the impeller 56. The rotation of the impeller 56 causes a primary air flow to be drawn into the body 12 through the air inlet 14. The user may control the speed of the motor 60, and therefore the rate at which air is drawn into the body 12 through the air inlet 14, by manipulating the dial 26. The rotation of the impeller 56 causes a primary air flow to enter the body 12 through the air inlet 14, and to pass to the air inlet 52 of the duct 50. The air flow passes through the duct 50 and is guided by the shaped peripheral surface of the air outlet 54 of the duct 50 into the interior passage 42 of the nozzle 18. Within the interior passage 42, the primary air flow is divided into two air streams which pass in opposite angular directions around the bore 32 of the nozzle 18, each within a respective section 44, 46 of the interior passage 42. As the air streams pass through the interior passage 42, air is emitted through the air outlet 20. The emission of the primary air flow from the air outlet 20 causes a secondary air flow to be generated by the entrainment of air from the external environment, specifically from the region around the nozzle 18. This secondary air flow combines with the primary air flow to produce a combined, or total, air flow, or air current, projected forward from the nozzle 18.

The invention claimed is:

1. A fan assembly comprising a base; a body mounted on the base for movement relative thereto between an untilted position and a tilted position, the body comprising at least one air inlet, an impeller and a motor for driving the impeller to draw an air flow through said at least one air inlet; at least one air outlet; an interior passage for conveying air to said at least one air outlet, the interior passage extending about an opening through which air from outside the fan assembly is drawn by air emitted from said at least one air outlet; a brake connected to the base for movement relative thereto; a stop member connected to the base; a section of the body being disposed between the brake and the stop member; and a resilient member for urging the brake towards the stop member to urge the section of the body against the stop member to maintain the body in a tilted position relative to the base by friction between the section of the body and the stop member, wherein the stop member comprises a first rail and the section of the body comprises a second rail extending substantially parallel to the first rail, the second rail comprising a recess on a first side surface of the second rail that faces the brake such that when part of the brake is moved into the recess an indication is provided that the body has been moved toward the untilted position.

2. The fan assembly of claim 1, wherein the brake is mounted on the upper surface of the base.

3. The fan assembly of claim 2, wherein the base comprises a plurality of brake guide rails connected to the upper surface of the base, and wherein the brake is secured to the brake guide rails for sliding movement along the brake guide rails.

4. The fan assembly of claim 2, wherein the stop member is connected to the upper surface of the base.

5. The fan assembly of claim 1, wherein the second rail comprises a second side surface located opposite to the first side surface, and wherein the brake is configured to engage the first side surface and the stop member is configured to engage the second side surface.

6. The fan assembly of claim 1, wherein each rail is curved.

7. The fan assembly of claim 1, wherein each rail extends in a direction which is parallel to the direction of movement of the body relative to the base.

8. The fan assembly of claim 1, wherein the brake is moveable relative to the base in a direction which is substantially orthogonal to the direction of movement of the body relative to the base.

9. The fan assembly of claim 1, wherein the brake is moveable relative to the base in a direction which is substantially orthogonal to an axis of rotation of the impeller when the body is in the untilted position.

10. The fan assembly of claim 1, comprising a seat connected to the base, and wherein the resilient member is located between the seat and the brake.

11. The fan assembly of claim 1, wherein the section of the body forms part of a plate connected to a lower surface of the body.

12. The fan assembly of claim 1, wherein the upper surface of the base is concave in shape, and wherein the lower surface of the body is convex in shape.

13. The fan assembly of claim 1, comprising a plurality of pairs of interlocking members for retaining the body on the base, wherein each pair of interlocking members comprises a first interlocking member located on the base and a second interlocking member located on the body and which is retained by the first interlocking member.

14. The fan assembly of claim 1, wherein movement of the brake into the recess as the body is moved towards the untilted position provides a variation in the force required to move the body relative to the base.

15. The fan assembly of claim 14, wherein the variation in the force required to move the body is a reduction in the force required to move the body relative to the base.

16. A stand for a fan assembly, the stand comprising a base; a body mounted on the base for movement relative thereto between an untilted position and a tilted position, the body comprising at least one air inlet, an impeller, a motor for driving the impeller to draw an air flow through said at least one air inlet, and an air outlet; a brake connected to the base for movement relative thereto; a stop member connected to the base; a section of the body being disposed between the brake and the stop member; and a resilient member for urging the brake towards the stop member to urge the section of the body against the stop member to maintain the body in a tilted position relative to the base by friction between the section of the body and the stop member, wherein the stop member comprises a first rail and the section of the body comprises a second rail extending substantially parallel to the first rail, the second rail comprising a recess on a first side surface of the second rail that faces the brake such that when part of the brake is moved into the recess an indication is provided that the body has been moved toward the untilted position.

17. The stand of claim 16, wherein the brake is mounted on the upper surface of the base.

18. The stand of claim 17, wherein the base comprises a plurality of brake guide rails connected to the upper surface of the base, and wherein the brake is secured to the brake guide rails for sliding movement along the brake guide rails.

19. The stand of claim 16, wherein the stop member is connected to the upper surface of the base.

20. The stand of claim 16, wherein the second rail comprises a second side surface located opposite to the first side surface, and wherein the brake is configured to engage the first side surface and the stop member is configured to engage the second side surface.

* * * * *